United States Patent [19]

Nishiyama et al.

[11] 4,010,907

[45] Mar. 8, 1977

[54] APPARATUS FOR AUTOMATICALLY SUPPLYING COPS TO A THREAD WINDER

[75] Inventors: Shigeyuki Nishiyama; Yoshio Orii, both of Amagasaki; Kotaro Tsurumi, Takatsuki; Kunio Nishimura, Amagasaki, all of Japan

[73] Assignee: Nihon Spindle Seizo Kabushiki Kaisha, Amagasaki, Japan

[22] Filed: Aug. 23, 1974

[21] Appl. No.: 500,211

[30] Foreign Application Priority Data

Aug. 24, 1973 Japan ..... 48-94938

[52] U.S. Cl. ..... 242/35.5 A; 242/35.6 E

[51] Int. Cl.[2] ..... B65H 54/20; B65H 54/26

[58] Field of Search ..... 242/35.5 A, 35.5 R, 242/35.6 R, 35.6 E

[56] References Cited

UNITED STATES PATENTS

| | | | |
|---|---|---|---|
| 2,010,465 | 8/1935 | Reiners et al. | 242/35.5 A |
| 2,052,895 | 9/1936 | Reiners et al. | 242/35.5 R |
| 2,177,763 | 10/1939 | Abbott et al. | 242/35.6 R |
| 2,208,930 | 7/1940 | Kahlisch | 242/35.6 R |
| 2,350,927 | 6/1944 | Reiners et al. | 242/35.5 A |
| 3,224,694 | 12/1965 | Oishi | 242/35.5 R |
| 3,279,710 | 10/1966 | Raasch | 242/35.5 R |
| 3,381,908 | 5/1968 | Igushi et al. | 242/35.5 R |
| 3,421,705 | 1/1969 | Benedict | 242/35.5 R |
| 3,506,209 | 4/1970 | Matsui et al. | 242/35.5 R |
| 3,774,859 | 11/1973 | Brouwer et al. | 242/35.5 R |

*Primary Examiner*—Stanley N. Gilreath
*Attorney, Agent, or Firm*—Blum, Moscovitz, Friedman & Kaplan

[57] ABSTRACT

An apparatus for automatically supplying cops to a winder includes a cop-feeder which moves along a track of the winder, the cop-feeder including means for stopping same in registry with each winding unit of the winder, storage for cops, a cop-feed-out section, a charging section for transferring cops from the feed-out section to the magazines of the winder, and means for grasping a yarn end and transferring same to a fresh cop. The apparatus also can determine whether a magazine has its full supply of cops, selectively halting the cop-feeder only at magazines which have an incomplete complement of cops and supplying the needed number of cops to the magazines. The travelling mechanism permits the feeder to stop only at every other magazine during a run in one direction along the track and at the remaining magazines on the return trip. Provision is made for feeding cops to magazines while the magazines are in rotation.

The method of operating the apparatus includes provision for varying the speed of the feeder along the track so that the cop feeder is brought to rest gently in position for feeding cops to a magazine in need of replenishment, and the use of an air current for positioning yarn ends, all without manual intervention.

6 Claims, 29 Drawing Figures

APPARATUS FOR AUTOMATICALLY SUPPLYING COPS TO A THREAD WINDER

BACKGROUND OF THE INVENTION

Heretofore, in supplying cops to each magazine mounted in juxtaposition to each winding unit of an automatic thread winder, it has been necessary for an operator to make the round of the winder to watch for any magazine devoid of cops and to perform a series of manual operations of supplying cops one by one to such magazine, taking out the yarn end and holding it on a yarn clamp. Such manual operations require much trouble and the labor cost runs up, and hence, such manual operations have proved to be a great hindrance to full automation of the winder operation.

SUMMARY OF THE INVENTION

In accordance with this invention, there is provided a system for automatically supplying cops to an automatic thread winder, which comprises a travelling cop feeder adapted to travel along the thread winder and to stop in registry with a cop-holding magazine of each winding unit and supply cops automatically to said magazine; means for detecting whether or not a cop is present in a cop-charging section resting in readiness in a cop-receiving position beneath a feed-out section of said cop feeder when a cop is charged to said cop-charging section through a feed-out section from the cop-containing section of the cop feeder and supplying cops selectively when no cops are present in the cop-charging section; a yarn take-out member for taking out the yarn end of a cop remaining in the cop-charging section or freshly supplied thereto and holding the yarn end on a picking section; means for sensing the presence or absence of a remaining cop in the magazine when the cop-charging section having a cop therein is lowered and reaches the position adjacent to the magazine at which the cop charging section charges the cop to the magazine and thus selectively charging and feeding the cop held on the cop-charging section to the magazine; and means for transferring the yarn end of the charged cop automatically to a yarn clamp of the magazine by a yarn endtreating section after the lowered cop-charging section has been lifted to the cop-receiving position and holding the yarn clamp.

In accordance with another aspect of this invention there is provided an apparatus for automatically supplying cops to an automatic thread winder which comprises a belt conveyor mounted alongside the machine frame of the thread winder and a chute device movable along the machine frame with its open end resting on the belt conveyor oriented in a direction opposite to the direction of advance of the belt conveyor, said chute device including a receiving device having a floating mechanism for lifting the travelling conveyor belt from its guide plate and a guide trough adapted to guide cops on the lifted belt while holding them from dropping unintentionally therefrom, wherein cops are supplied into a containing section of said cop feeder from the cop-delivering conveyor mounted above the winder even while the cop feeder is travelling and said conveyor is stopped or moved depending on the presence or absence of cops in said containing section so that a predetermined number of cops are automatically fed to said containing section.

In accordance with still another aspect of this invention, there is provided an apparatus for automatically supplying cops to an automatic thread winder, which comprises a travelling cop feeder mounted to travel reciprocatively along the machine frame of the automatic thread winder and to feed cops to magazines juxtaposed in parallel to the machine frame and a travel control device mounted so that the cop feeder is stopped for every other magazine for delivering a cop thereto when it proceeds in one direction and is stopped for each intermediate magazine for delivering cops thereto when it proceeds in the return direction.

In accordance with a still further aspect of this invention, there is provided an apparatus for automatically supplying cops to an automatic thread winder, which comprises a travelling cop feeder including a cop-charging section for receiving and holding cops which is adapted to be lowered to a cop-charging position proximate to a cop-holding magazine of the thread winder for charging a cop to said magazine; said travelling cop feeder further including synchronizing means adapted so that when the cop-holding magazine rotates on charging of cops, it entrains the cop-holding magazine in rotation to maintain the relative position between said cop-holding magazine and said cop-charging section, and a cop-charging mechanism; said cop-charging mechanism being constructed so that when the cop-charging section having a cop received and held therein is stopped in registry with each cop-holding magazine and is lowered to approximate the feed position of the magazine, rotation of a lid plate is allowed to release holding of the cop by engaging means, only when the feed position of the magazine is empty, the cop in the cop-charging section is charged into the magazine by its own gravity against the restoring force of the lid plate, when a cop is left in the feed position of the magazine, opening of the lid plate is inhibited by the top end of said remaining cop, to thereby accomplish selective feeding of cops depending on the presence or absence of the cop in the cop feed position of the magazine, and then the lid plate is kept closed by restoration of said engaging means and the cop-charging section is rotatingly restored to the cop-receiving position.

Accordingly, it is a primary object of this invention to provide an apparatus for automatically supplying cops to an automatic thread winder, in which the labor saving can be achieved through full automation of a series of operations in the thread winder.

Another object of this invention is to provide an apparatus for automatically supplying cops to an automatic thread winder, in which automatic feeding of cops to a cop feeder travelling along the thread winder is made possible by adoption of a conveyor system to thereby simplify the structure of the feeder and reduce the weight and size of the feeder, resulting in reduction of the manufacturing cost, and in which the operation of the conveyor is controlled automatically depending on the quantity of cops contained in a cop-containing section of the feeder, whereby supply of cops to the automatic winder can be performed assuredly with safety.

A further object of this invention is to provide an apparatus for automatically supplying cops to an automatic thread winder, in which a cop feeder travelling along the winder is stopped for each of every other magazine for delivering cops thereto to thereby reduce the total circuit time, eliminate the loss time and prevent deviation of the stop position, and in which at stopping of the cop feeder a high speed can be smoothly changed over to a low speed and the cop feeder can be stopped assuredly at the predetermined stop position without any shock by provision of a mechanical stopping device, whereby feeding of cops can be performed effectively under satisfactory conditions.

A still further object of this invention is to provide an apparatus for automatically supplying cops to an automatic thread winder, in which the cop-charging section can rotate synchronously with each magazine so that cops can be supplied accurately and automatically into each cop-holding magazine even when the magazine rotates as the cops are fed thereto, and in which even when the magazine contains a remaining cop, the presence of the remaining cop can be detected and the risk of double feeding can be eliminated, whereby occurrence of mis-feeding or operation trouble can be effectively prevented.

Yet another object of this invention is to provide a simplified and economical cop feed device, in which in supplying automatically cops to each cop-holding magazine of an automatic thread winder, even when the magazine rotates, occurrence of malfunction can be prevented and supply of cops can be performed accurately and assuredly.

Yet a further object of this invention is to provide an apparatus for performing an automatic thread winder operation continuously and completely automatically, in which the operations of guiding the end yarn spread on a cop, fed and supplied to a magazine of the thread winder to a yarn clamp of the magazine and holding it on the yarn clamp, can be performed automatically without the assistance of manpower.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
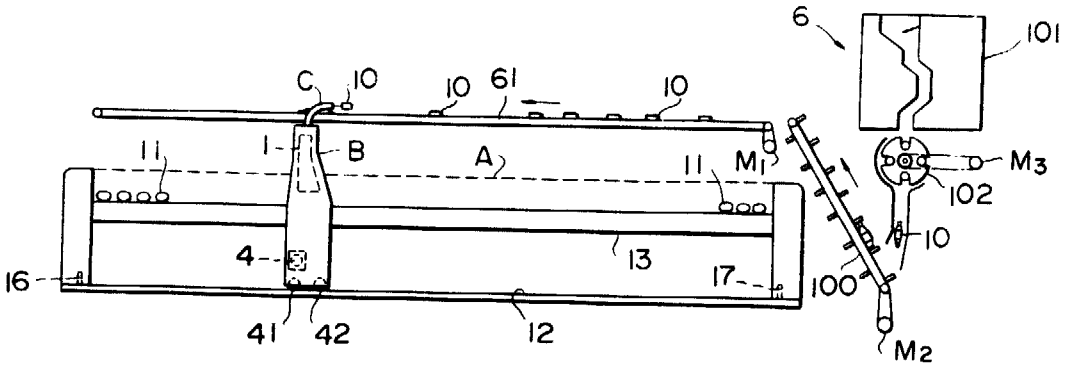
FIG. 1 is a front view of an embodiment of the present invention.

In FIG. 1, an automatic thread winder A has a number of juxtaposed winding units, rotary type cop magazines 11 arranged in registry to said winding units for delivery and supply of cops 10 to said winding units, and travelling and guiding rails 12 and 13. A travelling cop feeder B is disposed to reciprocate on said rails along the front face of the winder A and supply cops 10 successively into magazines 11 during this reciprocating movement. This cop feeder B comprises means for stopping the travelling cop feeder at appropriate positions and a cop-charging device. A delivery device C is arranged above the winder to form a unit for automatically replenishing the feeder B with cops.

This delivery device C comprises an endless belt conveyor 61 laid along the entire length of the winder A and rotated at a speed higher than the running speed of the cop feeder B, a lifting conveyor 100, and a cop-replenishing section 6 including a stock hopper 101 for feeding cops to the conveyor 100. Cops 10 are loaded on the conveyor 100 one by one from the stock hopper 101 in one oriented direction through a draw-out rotor 102. In this case, each section is driven synchronously by motors M1, M2 and M3.

As shown in FIGS. 2 to 5, the travelling cop feeder B for supplying cops automatically to magazines while travelling along the winder A comprises a cop-containing section 1 having, for example, a zigzag passage for storing a plurality of cops 10 in parallel rows, a feed-out section 2 including a feeding mechanism **2*a* for feeding the cops sequentially from the containing unit 1 and a guide trough 2*b* (FIG. 5) for guiding the cops therealong, a charging section 3 (FIG. 2) for receiving and holding the descending cops at the receiving position beneath the feed-out section and selectively charging the cops into the cop pocket of the magazine, a driving and stopping mechanism 4 (FIG. 5) for driving each above section, comprising a driving mechanism 4***a* including driving rollers 41 and 42 (FIG. 4) and guide rollers 43 (FIG. 3) and 44 adapted to roll on said rails 12 and 13 for moving the feeder B along the winder A and a change-over mechanism 4*b* (FIG. 2) for reversing the direction of travel of the cop feeder at the end extremity of the thread winder, and a stop position control section 5 (FIG. 2) for momentarily stopping the cop feeder when the latter is moved to a position registering with a magazine 11 (FIG. 3) of the thread winder A.

A chute device 62 (FIG. 2) is projectedly mounted on the top of the feeder proper B. Said chute device 62 is positioned with its open end resting on the conveyor belt and facing in a reverse direction to that of movement of the conveyor belt 61 for picking up the cops 10 transferred on the conveyor belt 61 laid above the frame of the winder A as the feeder proper reciprocates and for guiding the picked cops laterally and supplying them into said container section 1. An internal passage is provided in the container section 1 of the feeder proper B for accommodating a prescribed number of cops 10 in a horizontal and end-to-end relation, and upper and lower limit switches LSul and LSu2 for sensing the quantity of cops in said passage, a switch LSd1 for driving the conveyor 61 and a limit switch LSd2 for stopping the feeder B are provided in suitable positions in said passage of the containing section 1.

These switches may be turned on and off for controlling the cop quantity supplied by the conveyor belt 61 and stored in the containing section.

Figure 13:
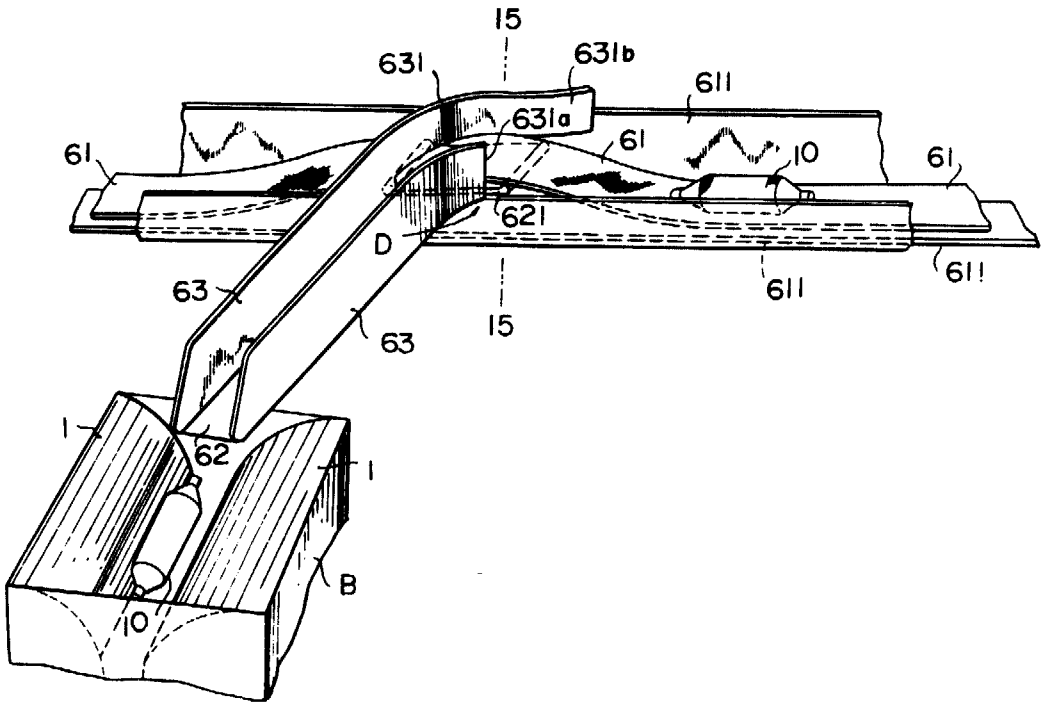
FIG. 13 is a perspective view of the cop-receiving device.
Figure 14:
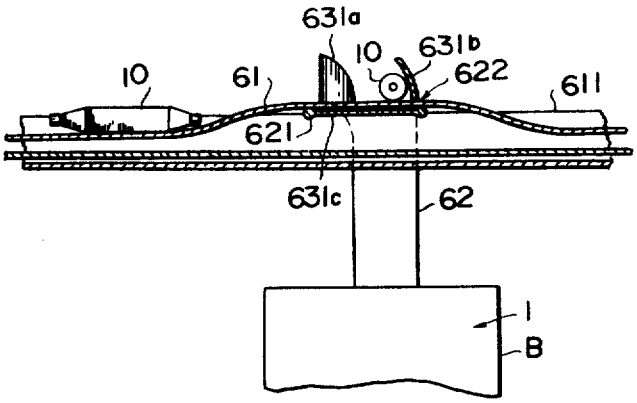
FIG. 14 is a sectional front view of the cop-receiving device of FIG. 13.
Figure 15:
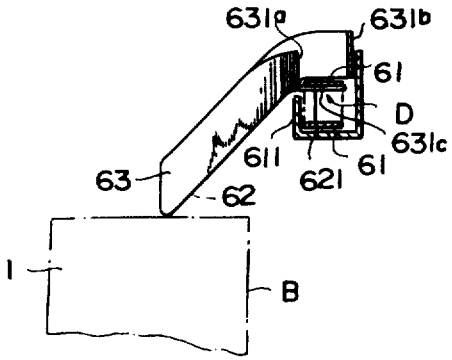
FIG. 15 is a sectional side view taken on the line 15—15 of FIG. 13.

As shown in FIGS. 13 to 15, the chute device 62 comprises trough-shaped guide passageway 63 secured at the lower end to the containing section 1 of the feeder B, belt floating mechanism D for belt conveyor 61, D being secured to the upper end of the guide passageway 63, and guide trough 631 for the cop 10 also secured to the upper end of the guide passageway 63 for floating the travelling belt 61 so as to move it slidingly.

The floating mechanism D is so constructed that the bottom plate 62 of the trough-shaped guide passageway 63 resting on lateral guide plate 611 on the cop take-out side of the belt conveyor 61 and facing to the belt path is inserted below the belt 61 for uplifting the latter from the upper surface of the guide plate 611. Guide means 621 such as a curved surface or rollers are provided on the both edges of the bottom plate 62 or at least on the sides opposite to the direction of movement of the conveyor belt for reducing the wear and avoiding the destruction of the belt 61.

Guide trough 631 is constructed of a pair of bent plates 631*a* and 631*b* open in the direction of movement of the conveyor belt 61. The foremost part of one of the bent plates 631*a* is formed as an upright wall adjacent to the guide plate 611 of the conveyor 61, and the other bent plate 631 provides a slit 622 (FIG. 14) for belt passage between the guide passageway 63 and the bottom plate 631*c* and extends along the inner surface of the guide plate 611. The cop 10 conveyed on the belt 61 guided by these bent plates 631 is thereby safe-guarded from falling laterally at the belt floating point and is diverted into passageway 63 from the opening between the bent plates.

In a modified embodiment (not shown) of the cop-supplying system, there may be provided a cop supply hopper to the winder frame for automatically supplying the cops therefrom into the cop-containing section 1 when the cop feeder B has reached the end extremity of the winder frame.

Each rotary magazine 11 has a space sufficient for containing 6 cops therein, namely six pockets, and when cops 10 are made empty by unwinding, two cops are supplied to the feeding position of the magazine 11 (FIG. 5) being rotated for supply of cops. It is possible to feed cops one by one or feed three or more of cops at a time.

Feed-out section 2 provided at the lower end of the containing section 1 for feeding the cops 10 into the charging unit comprises an arcuate control member 22 (FIG. 2) pivoted at the arcuate portion thereof and connected at the other end to a solenoid $SOL_2$ (FIG. 4) which allows a cop to be fed when energized but normally holds the cop in said member 22; a stop member 23 (FIG. 2) pivotally mounted at one end back of the control member 22 so as to stop the rolling of the cop 10 and to be rotated synchronously with control member 22 through gearing 24 to permit the passage of the cop; a support member 26 beneath said stop member 23 for carrying one end of the cop and connected to a solenoid $SOL_1$ so as to be rotated periodically to permit the descent of the cop; and a pair of juxtaposed guide channels 27*a*, 27*b* (FIG. 5) mounted respectively beneath said support member 26 and back of the stop member 23 for guiding the cops to the charging section 3 from the rotating support member 26 by rotation thereof and beyond the stop member 23 from the extension line thereof. In this way, two cops can be fed out selectively from the feed-out section into the charging section 3.

Further details on the structure and manner of operation of the feed-out section 2 and the structure of elements 22, 23, 29 and 26 and the manner in which elements feed cops are presented in U.S. Pat. No. 3,933,320. Said patent is incorporated by reference as if fully set forth herein.

Figure 5:
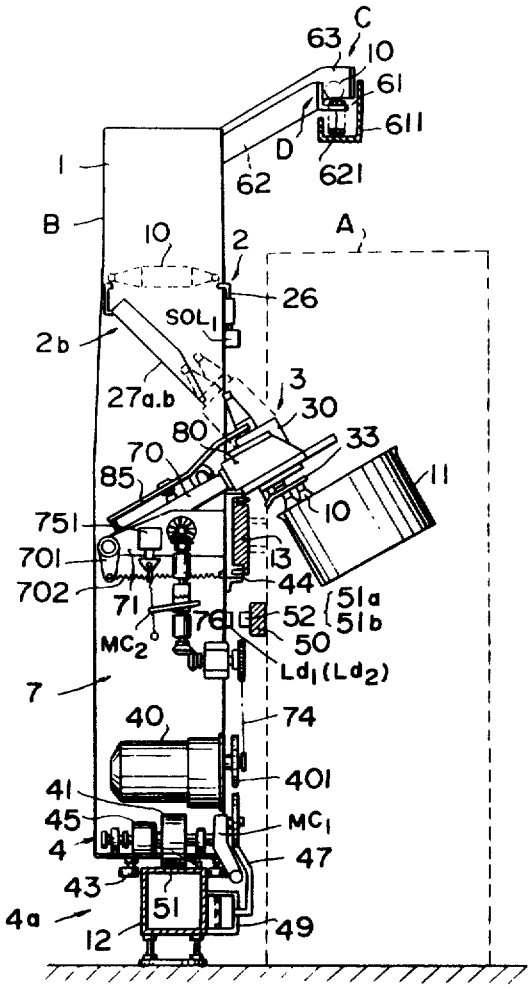
FIG. 5 is a side view showing a section taken along line 5—5 in FIG. 2.
Figure 6:
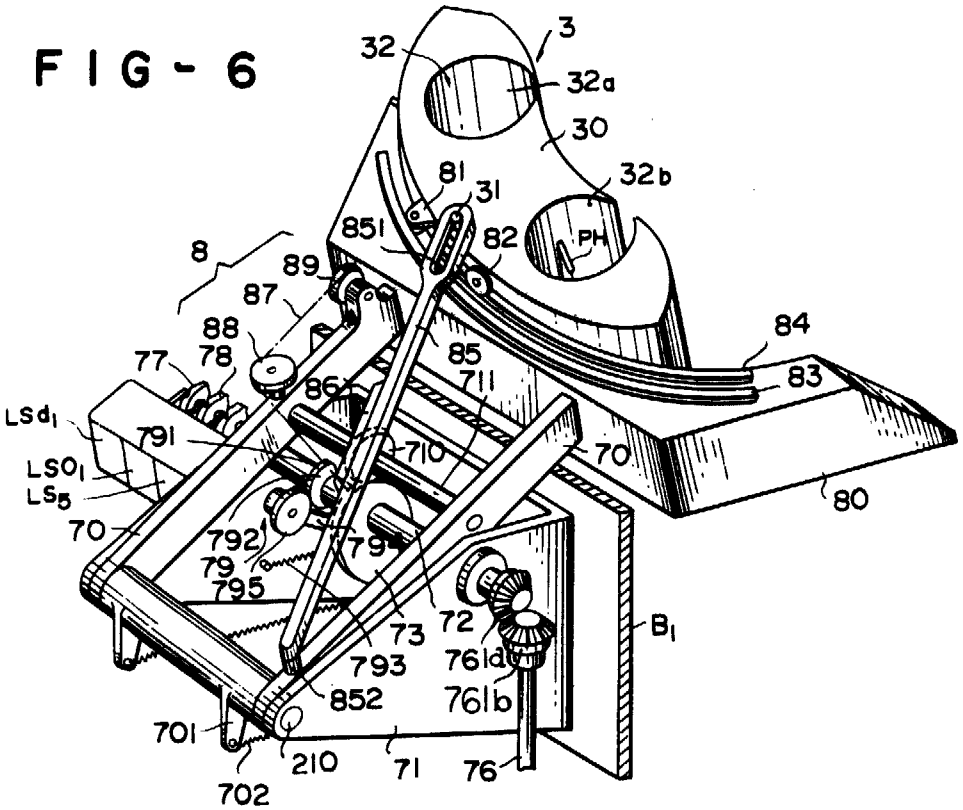
FIG. 6 is a perspective view of the charging section and lifting and lowering mechanism of the feeder.
Figure 7:
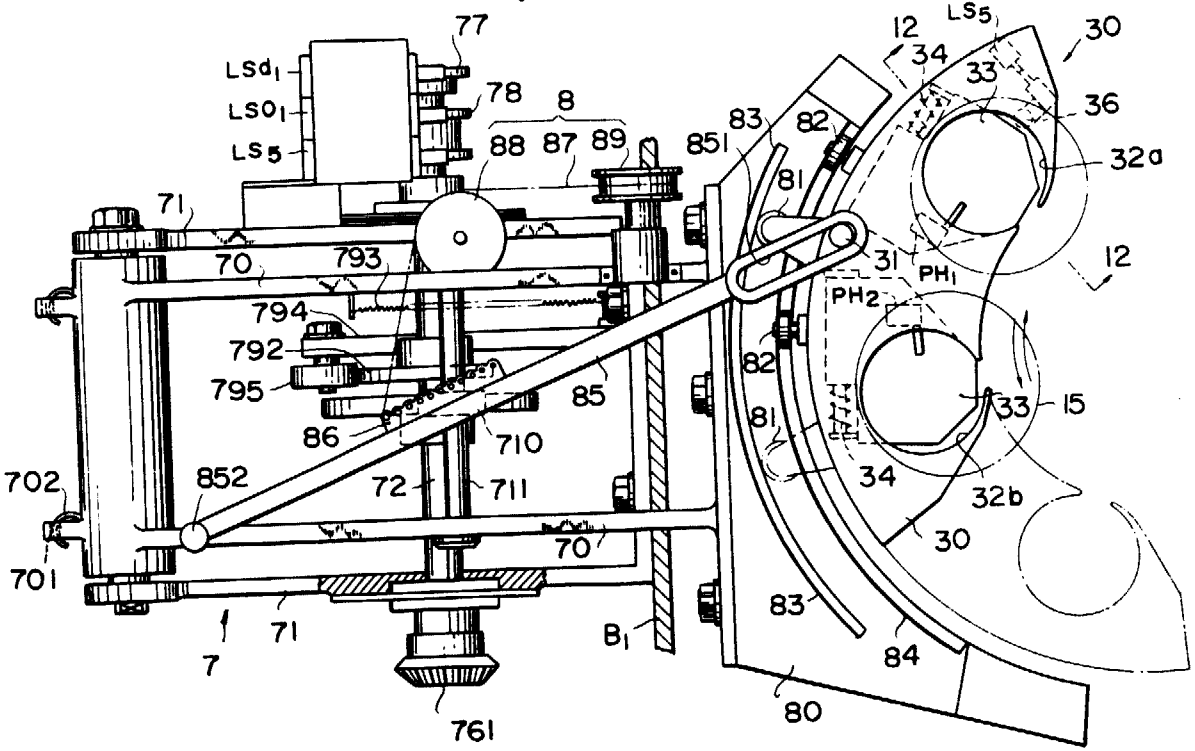
FIG. 7 is a plan view of the charging unit shown in FIG. 6.

As shown in FIGS. 5 to 7, charging section 3 comprises a cop holder 30 (FIGS. 5 and 6) for receiving and holding the cops 10 fed from feed-out section 2 by gravity; a lifting means 7 (FIG. 5) for moving the holder 30 vertically to a cop-receiving position or to a cop-charging position proximate to the magazine 11; synchronizing means 30' (FIG. 12) for synchronized rotation of the charging section 3 with that of the magazine 11 for maintaining the charging position; a self-centering device 8 (FIG. 6); and charging control means 9 for sensing the existence or non-existence of the cops in the pocket of the magazine 11 and accordingly charging the cops held by the holder 30 or refraining from charging them.

The holder 30 is formed into a sector shape having substantially the same radius of curvature as that of magazine 11 and is provided with a pair of longitudinal cop-receiving cavities 32*a*, 32*b* in registry with the guide channels 27*a*, 27*b* of the feed-out section 2 and with the distance between adjacent pockets 15 in magazine 11. Cover plates 33, 33 (FIGS. 5 and 7) are pivotally mounted adjacent to the lower ends of the cavities 32 (FIG. 6) and the cover plate 33 is urged to move upwards by a spring 34 (FIG. 7) mounted about pivot 331. The spring force of the spring 34 is selected to be such that the cover plate 33 is normally held against the open end of the cavity 32 but can be lowered under the weight of the cop contained within the cavity 32.

Said lifting means 7 is so constructed that the cop holder 30 is carried movably by part of a lifting frame 70 (FIGS. 6 and 7) pivotally mounted to a pair of brackets 71 fixed to a suitable portion of cop feeder B and comprises cam 73 (FIG. 6) mounted on cam shaft 72 rotatably carried at the ends thereof by brackets 71, and cam follower 710 mounted on transverse rod 711 which is mounted in turn on lifting frame 70. The lifting frame 70 can thus be swung essentially vertically with rotation of cam shaft 72.

An end gear 761*a* on the cam shaft 72 engages with end gear 761*b* on rotatable shaft 76 connected to the driving means 40 (FIG. 5) of the driving section 4 through motion-transmitting means 74 and magnetic clutch MC2. The magnetic clutch MC2 is controlled by switches LS1, LS2 and LS5 operated respectively by cams 77, 78 mounted on the end of control shaft 72 and by sensor switch LS4 in stop position control section 5 (FIG. 2) described below.

Figure 8:
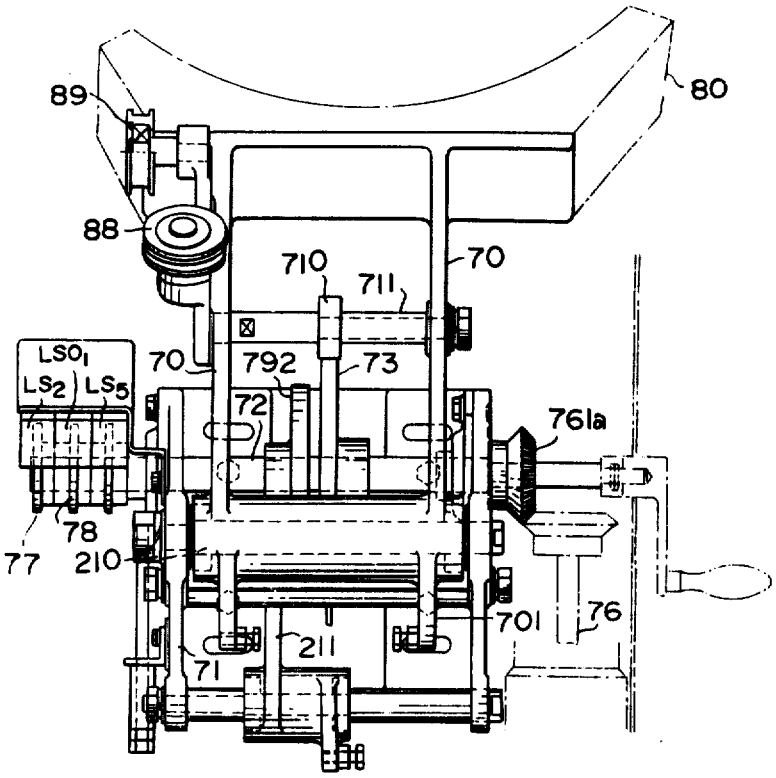
FIG. 8 is a front view of the charging unit shown in FIG. 6.

Cams 77, 78 (FIGS. 7 and 8) mounted at the ends of the control shaft 72 open the microswitch LS2 when the lifting frame 70 rises and they retreat from the magazine, and hence, the electromagnet MC2 of the lifting mechanism 7 is opened to stop driving of the control shaft 72 and lifting frame 70. Then, when the inertial rotation of the control shaft 72 is stopped, the switch LS5 is closed to initiate driving of the travelling mechanism 4*a*.

A stop means 79 (FIG. 6) for control shaft 72 comprises a stop cam 792 having a recessed groove 791 and rotatable integrally with cam shaft 72, and an arm 794 including a roller 795 pivotally mounted at the base end to support bracket 71 and abutting with a light pressure on said stop cam 792 under the force of spring 793. This stop means engages and holds the cam shaft 72 as the lifting frame 70 is elevated to the receiving position for safeguarding the shaft 72 and the lift frame 70 from shifting during travel of the cop feeder B.

A spring 702 is mounted under tension between a boss 701 on the base end of lift frame 70 and the bracket 71 to resiliently compensate for any rotational moment due to the weight of the lift frame 70 and the holder 30.

The self-centering device 8 is mounted to the foremost part of the lift frame 70 for pivotally carrying the holder 30 and comprises, as shown in FIG. 7, a swingable guide frame 80 having an arcuate shape concentric with that of the magazine 11 and formed with horizontal and vertical guide rails 83, 84 on the upper and lower surfaces thereof, and guide wheels 81, 82 mounted on the back surface of the holder 30 are perpetually received within these guide rails so that the holder 30 is movable along the arcuate passage in synchronism with the magazine 11.

Self-centering operation of the holder 30 is attained by a device comprising a lever arm 85 having an oblong slot 851 at its end for engaging with a boss 31 on the holder 30 and pivotally mounted at its base end 852 to the lifting frame 70, and a traction cord 87 fastened to one of a series of openings 86 formed on the lever arm 85 and coupled at the other end with a weight, not shown, through rollers 88 and 89. The lever arm 85 is forced into partial rotation under traction of the cord 87 for permanently positioning the holder 30 in the cop-receiving position.

Figure 10:
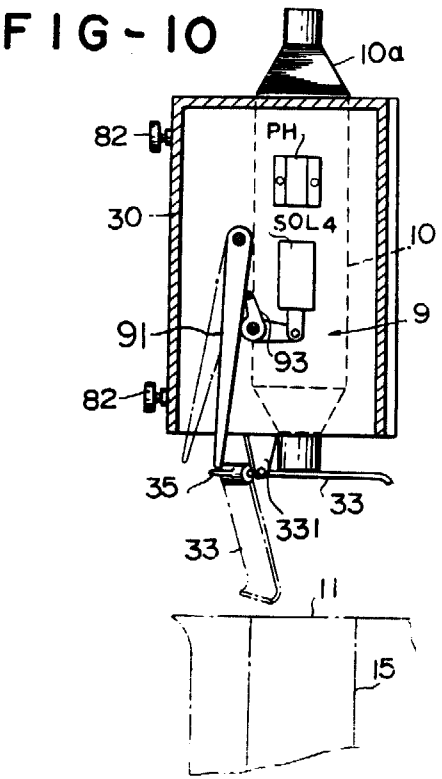
FIGS. 10 and 11 are sectional side views of the charging unit at the time of a cop-charging operation.
Figure 11:
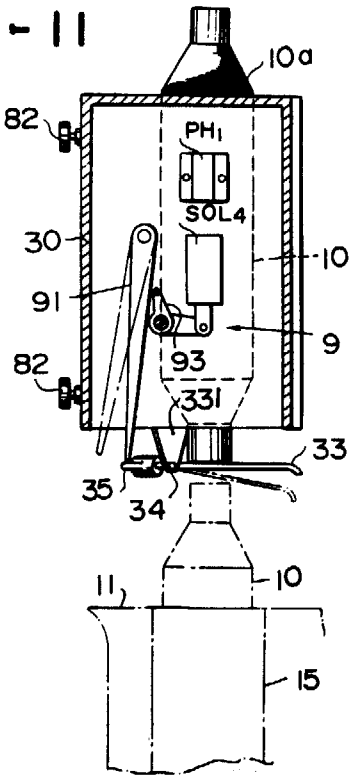

A charging control device 9 is provided as shown in FIGS. 10 and 11 at the base end of the cover plate 33. This charging control means 9 comprises an engaging lever 91 pivoted at its upper end and contacting at its lower end projection 35 on the base end of the cover plate 33, and control lever 93 mounted in proximity to said engaging lever 91 and adapted for partial rotation on energization of a solenoid SOL4 for disengaging the lever 91 from the projection 35 on the cover plate 33. The arrangement is such that, as the holder 30 is lowered, cover plate 33 is opened by disengagement of the lever 91 from the projection 35 thus permitting the cop to drop of its own weight, but if there is already a cop in the cop-receiving pocket 15 in the magazine 11, the cover plate 33 is prevented from opening by its contact with the top end of the cop, and kept closed by reengagement of the lever 91 with the projection 35 just before the holder 30 starts its upward stroke. In this way, the charging of the cops 10 can be controlled through sensing the presence or absence of cops in individual pockets of the magazine 11. Detector switches PH provided with feeler means facing to the inside of the cavities 32*a* and 32*b* are also mounted in opposition within said cavities 32*a*, 32*b* for detecting the existence of cops in the cavities 32 for selective actuation of the feed-out section 2. Selective actuation of the feed-out section 2 can also be accomplished by detectors PH 1 and PH 2 using a phototube (not shown).

Figure 12:
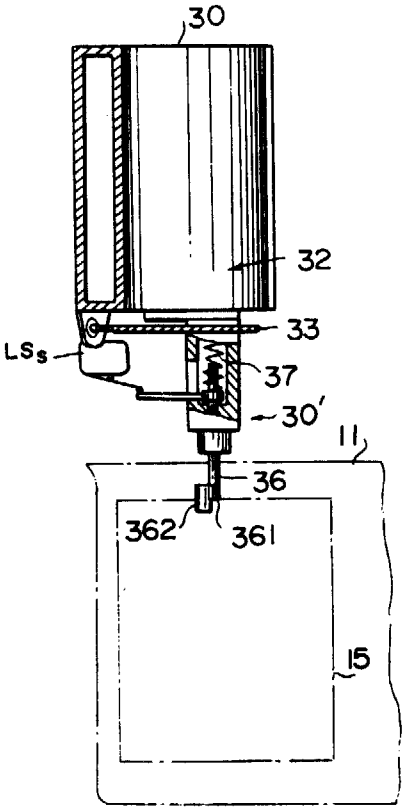
FIG. 12 is a sectional side view taken on the line 12—12 of FIG. 7.

As shown in FIG. 12, an engaging lever 36 has a hook 362 provided with a step 361 engageable with the rim of each cop-receiving pocket for charging a cop, the cop-receiving pockets being arranged in a circle in magazine drum 11. The engaging lever 36 is resiliently and fully movably vertically and is normally biased downwards under the force of the spring 37. The vertical movement of the engaging lever 36 is sensed by a limit switch LS2 which thus controls the extent of descent of the holder 30 and detects whether the cavity 32 in the holder 30 is correctly aligned with the top of the receiving pocket 15 in the magazine 11. The device so far described is also used as synchronizing means 30' whereby the holder 30 can be rotated in synchronism with rotation of the magazine drum 11 when the latter rotates.

The travelling mechanism 4*a* mounted on the lower part of the cop feeder B comprises a high speed driving roller 41 (FIG. 2) and a low speed driven roller 42 both rolling on the rail 12, guide rollers 43 (FIG. 3) rolling on the lateral faces of the rail 12 for preventing the lateral deviation of the cop feeder B, and a guide roller 44 (FIG. 5) rolling on guide rail 13 mounted on the lateral surface of the thread winder A. The shaft of the high speed drive roller 41 is provided at one end with a braking device 45 of low braking power and is connected at the other end to a motion transmitting device 46 (FIGS. 3 and 4) through magnetic clutch MC1 for driving simultaneously by the driving means 40.

The lower part of the cop feeder B (FIG. 4) is provided with a change-over mechanism 4*b* so designed that a slidably mounted push rod 47 is mounted engageably with a swingable plate 461 of motion-transmitting device 46. The ends of rod 47 project from both sides of the cop feeder B for making a change-over of the device 46 and reversing the rotation of the driving roller 41 when contacting stops 16 and 17 at both ends of the winder A at the end of the stroke of the push rod 47. A changeover switch LS01 is provided in proximity to a flange 471 mounted on a push rod 47. The push rod 47 abuts on the stops 16, 17 at the stroke end and operates switch LS01 for making a change-over of the travelling control circuit and reversing the direction of movement of the cop feeder B.

The motion-transmitting device 46 carries a gear train on the swingable plate 461 swinging with the shaft of drive roller 41 as center. The gear train meshes permanently with the gear of the drive roller 41 and can be disengaged from drive gear 401 of the drive unit 40 for reversing the rotational direction through gear rows.

Said low speed driven roller 42 is driven by its shaft to which the rotation is transmitted from the shaft of the high speed driving roller 41 through a chain 463 by a sprocket of an intermediate shaft reduced by reduction and intermediate gears 462. As in the case of the shaft of the roller 41, a similar control device 45' and an electromagnetic clutch MC3 are mounted on the shaft of the low speed driven roller 42.

Stop position control section 5 is so designed that the charging unit 3 of the cop feeder B can be halted in a position accurately registering with the cop pocket of the magazine 11 of the thread winder A and the cop feeder B is stopped for every other of magazines juxtaposed along the winder A. Namely, the feeder B is stopped for every other magazine during the going travel and is stopped for every alternate magazine during the returning travel.

This construction can be realized, for example, by providing a suitable electric circuit or mechanical means to the cop feeder whereby every other signal transmitted from the positioning plates mounted suitably on the machine frame of the thread winder with the pitch of the magazines is sensed for operating the magnetic clutch MC1 of the driving roller 41 and driven roller 42 and the braking devices 45 and 45', or providing two series of positioning plates alternately on the winder and two series of sensing means on the feeder corresponding to said positioning plates and making a change-over at the stroke end of the feeder between said two series of sensing means.

In the present embodiment, magnetized rectangular positioning members 52 (FIG. 3) are arranged before the magazine so that their facing directions differ by a right angle between two adjacent members. Two reed switches Ld1, Ld2, (FIGS. 3 and 4) are mounted at right angles to each other on the cop feeder B so that these reed switches can be turned on when registering with the respective directions of the positioning members 51*a*, 51*b* (FIG. 4). These switches Ld1, Ld2 are connected in parallel in the stopping circuits 304 (FIG. 28B) of the travelling unit 4*a* for making a change over between the two stop circuits by operation of the change-over switch LSO1 (FIG. 4) of the change-over unit 4*b*.

The stop position control unit 5 consists essentially of an electrically operated primary control means operable to turn on reed switches Ld1, Ld2 mounted on the feeder B when the latter are brought into registering position with the positioning members 52 (FIG. 3) for disconnecting the clutch MC1 on the side of the high speed roller 41 of the travelling unit 4 and turning on the clutch MC3 on the side of the low speed roller 42 for setting the feeder B into low speed rolling and a mechanically operated secondary control means whereby the feeder B can be stopped precisely without deviation by engagement with a groove 54 (FIG. 2) mounted on the positioning plate 51 mounted along the travel rail 12. The mechanically operated secondary control means comprises a detent pin 55 resiliently abutting on a positioning plate 51 by a spring 551 so as to be engageable with a groove 54 formed on the positioning plate 51 in the position facing to the magazine 11; a solenoid SOL 3 for forcibly lifting the detent pin 55 from the groove 54 of the positioning plate 51, and switches LS 4 and LS 14 for sensing the engagement of the detent pin 55 with the groove 54 on the positioning plate 51. The cop feeder B can be positively stopped and held in the stop position by engagement of the detent pin 55 with the groove 54 on the positioning plate 51.

Between the above-mentioned feed-out section 2 and charging section 3, there is disposed a vertically movable yarn end take-out mechanism 105 for unwinding a bunched yarn of the cop 10 received in said charging section and taking out the end yarn 10*b* of the cop 10.

An embodiment of this yarn end take-out mechanism 105 is disclosed in FIGS. 16 to 21. This embodiment includes a cylindrical cover 134 (FIG. 17) for receiving the top end of the cop in the state fitted therein, an exhaust section 135 opened and connected to one end of said cylinder 134, and an air feed section 136 disposed in the vicinity of the other end of said cylinder 134 to project compressed air with a certain angle to the bunched yarn 10*a* of the cop to unwind it. This air feed section 136 is provided with a swinging mechanism 137 for lifting and lowering the cylindrical cover 134.

Figure 16:
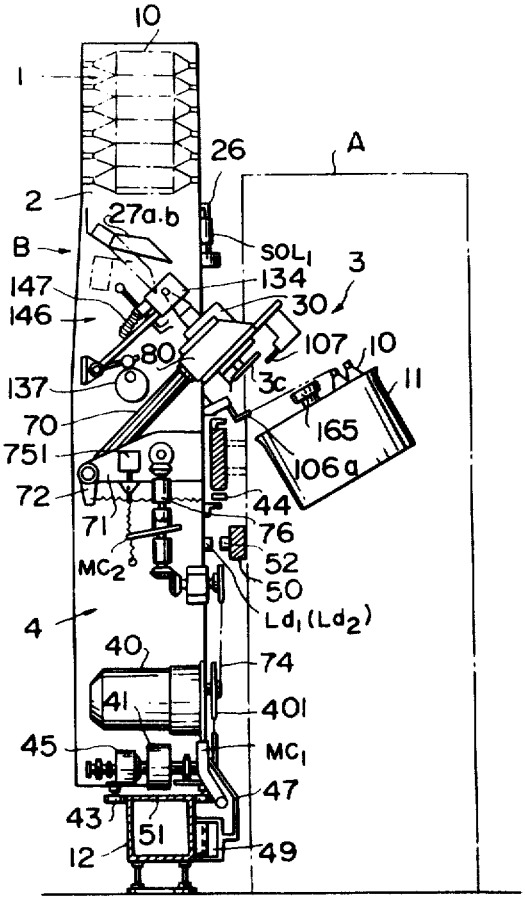
FIG. 16 is a side view illustrating the operation of the yarn take-out mechanism.
Figure 17:
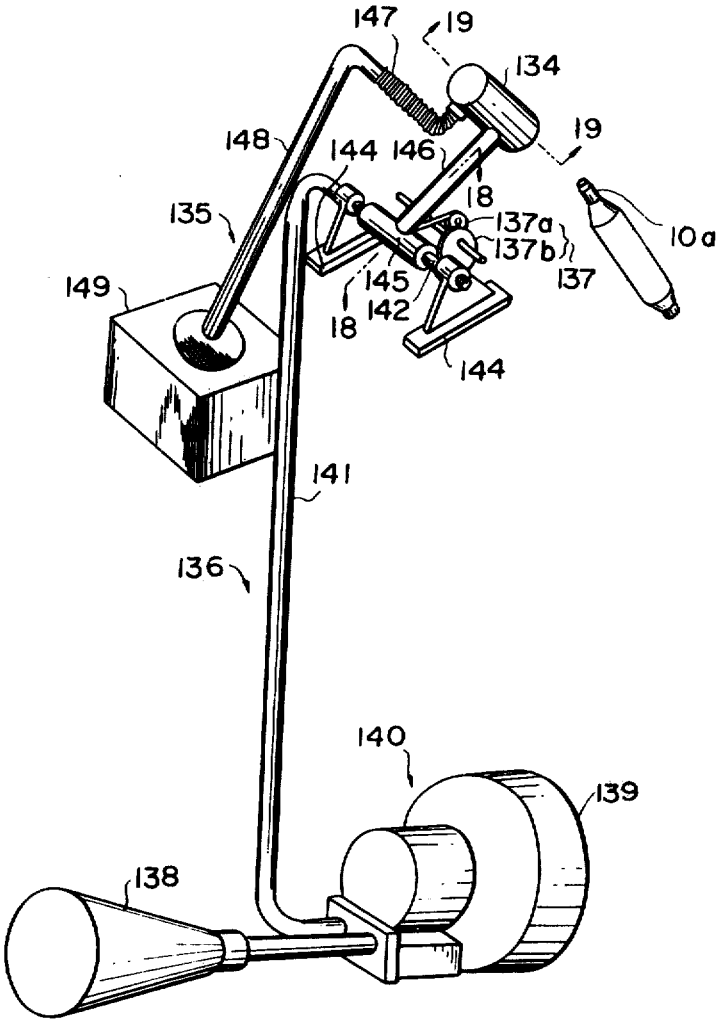
FIG. 17 is an enlarged perspective view of the yarn take-out mechanism shown in FIG. 16.
Figure 18:
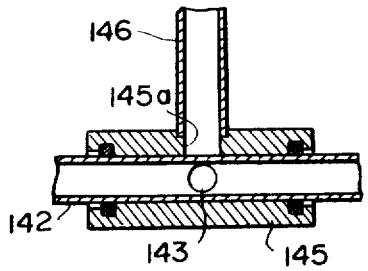
FIG. 18 is a sectional side view taken along the line 18—18 of FIG. 17.

More specifically, in FIGS. 16 and 17, the air feed section 136 comprises a compressed air source 140 which includes a suction filter 138 and a blower 139 for sucking air therefrom, a conduit 141 and a hollow supporting shaft 142, said air source 140 being connected to said hollow supporting shaft 142 through said conduit 141. Said hollow supporting shaft 142 is supported by a pair of brackets 144 and has a ventilation hole 143 (FIG. 18) perforated in an appropriate position. A hollow rotary shaft 145 is fitted around the periphery of the supporting shaft 142, and this hollow rotary shaft 145 has ventilation hole 145*a* in registry with said ventilation hole 143 and an air feed pipe 146 connected to said hole 145*a*. Said hollow rotary shaft 145 (FIG. 17) is rotated by a swinging mechanism 137 having an arm projected therefrom, a roller 137*a* pivoted on the top end of said arm and a cam 137*b* disposed to face the roller 137*a*. The cam 137*b* is driven by a motor IM3 (FIG. 2) so that the air feed tube 146 is lifted and lowered in the vertical plane. When the top end of the cop 10 is enclosed by the cylindrical cover 134, the ventilation holes 143 and 145*a* are connected to each other so that projection of air is accomplished.

Said exhaust section 135 is connected through a flexible exhaust tube 147 opened to the bottom of the cylindrical cover 134 and an exhaust conduit 148 to an exhaust filter 149 for storing yarn waste removed by filtration.

Said cylindrical cover 134 comprises a bottomed cylindrical base 150 (FIG. 19), a cylindrical cap 151 fitted in the open end of said base, and a guide piece 154 gripped between the base and cylindrical cap to define an annular passage 152 and a nozzle portion 153. Said exhaust section 135 (FIG. 17) is opened and connected through exhaust tubes 135 and 147 to an end portion of the side wall of said bottomed cylindrical base 150 (FIG. 19) at a point close to the bottom thereof, and an inwardly inclined conical face 150*a* and a stepped portion are formed on the other end portion of the side wall. A small diameter cylinder 150*b*, a shoulder 150*c* and an engagement portion 150*d* are formed on said stepped portion.

One end of said cylindrical cap 151 is hinged and capped on the engagement portion 150*d*, and on the other end of the cap 151 there are projected inwardly in the radial direction of plurality of capping position-determining members 151*a* butting to the conical wound portion of the cop, and outer air passages 151*b* (FIG. 20) are formed between every two position-determining members 151*a*. The radius of each member 151*a* defines the position of insertion of the cop 10 into the cylindrical cover so that projected air impinges against the bunched yarn 10*a* of the cop 10 at a certain angle. The guide piece 154 gripped between said base 150 and cap 151 includes a cylindrical portion 154*b* (FIG. 21) to be inserted into said cap 151, and outer and inner conical faces 154*a* and 154*c* extending substantially along the inclined conical face 150*a* of the base 150 and the conical wound portion of the cop 10, respectively. Several projections 154*d* are mounted on the outward top end portion of the guide piece so that they are spaced apart from one another at certain distance and they butt to the conical face 150*a* of said base 150. A projection nozzle portion 153 is formed between the conical face 150*a* of the base and the conical face 154*a* of the guide piece. In this case, air stream projected from the nozzle portion 153 is swirled by inclining or twisting the projections 154*d*. When the air stream is swirled on the direction for unwinding the bunched yarn, the yarn end take-out operation can be accomplished effectively. For this purpose, an annular passage 152 is formed in the small diameter cylinder 150*b* of said base 150, the inside face of the cap 151 and the outside conical face 154*a* of the guide piece, thus connecting said air feed section 136 (FIG. 17) through conduits 141, 142 and 146 to said annular passage 156.

The yarn end take-out operation can be performed by the sucking method or mechanical impinging method instead of the above air-projecting method.

The operation of the yarn end take-out mechanism having the above structure will now be described.

Figure 19:
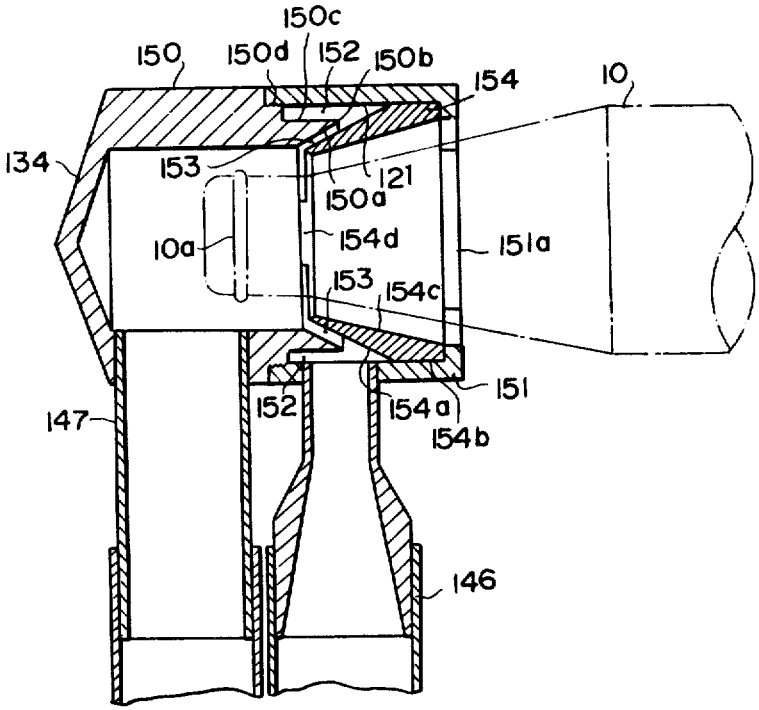
FIG. 19 is a sectional side view taken along the line 19—19 of FIG. 17.

Air coming from the compressed air source 140 of the air feed section 136 passes through the conduit 141 and reaches the hollow portion of the hollow supporting shaft 142. If the cylindrical cover 134 is positioned above and separate from the cop 10, the ventilation hole 145*a* (FIG. 18) of the hollow rotary shaft 145 is not connected with the ventilation hole 143 of the supporting shaft 142. When the cam 137*b* (FIG. 17) is rotated by operation of the swinging mechanism 137, the air feed pipe 146 is rotated below and lowered so that the cop is capped by the cylindrical cover 10 and the position-determining member 151*a* butts on the conical wound portion of the cop 10. As a result, the ventilation hole 145*a* of the hollow supporting shaft 145 is connected with the air feed tube 146, and compressed air is projected at a predetermined angle to the bunched yarn 10*a* from the nozzle portion 153 through the annular passage 152. In this case, if the shape of the cam 137*b* is so designed that pulsatory motions occur twice or thrice, unwinding of the bunched portion 10*a* is accomplished assuredly by the compressed air stream, and the secondary air stream guided through the outer air passage 151*b* of the cap 151 by the projected air stream promotes unwinding of the bunched yarn 10*a*. The unwound yarn passes through the exhaust tube 147 and reaches the exhaust filter. In this case, if, as shown in FIG. 19, the exhaust tube 147 is connected in a direction vertical to the axis of the cop 10 so that the top end of the cop is not spaced from the exhaust section 135, the yarn is unwound from the bunched portion alone and hence, over-unwinding is controlled.

Figure 23:
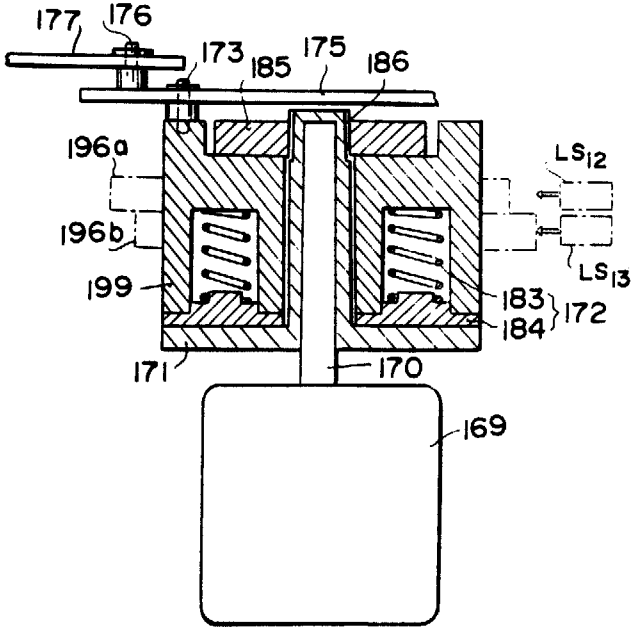
FIG. 23 is a sectional side view taken along the line 23—23 of FIG. 22.
Figure 20:
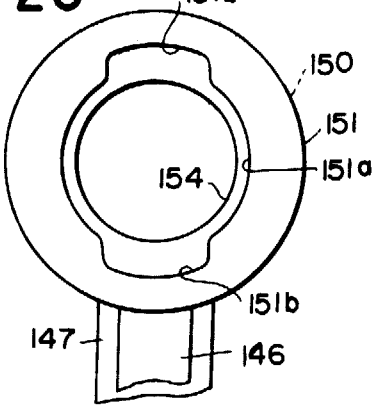
FIG. 20 is a back view of the yarn take-out mechanism of FIG. 16.
Figure 21:
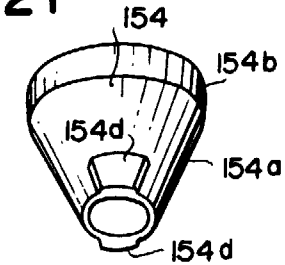
FIG. 21 is a perspective view of the guide piece.
Figure 22:
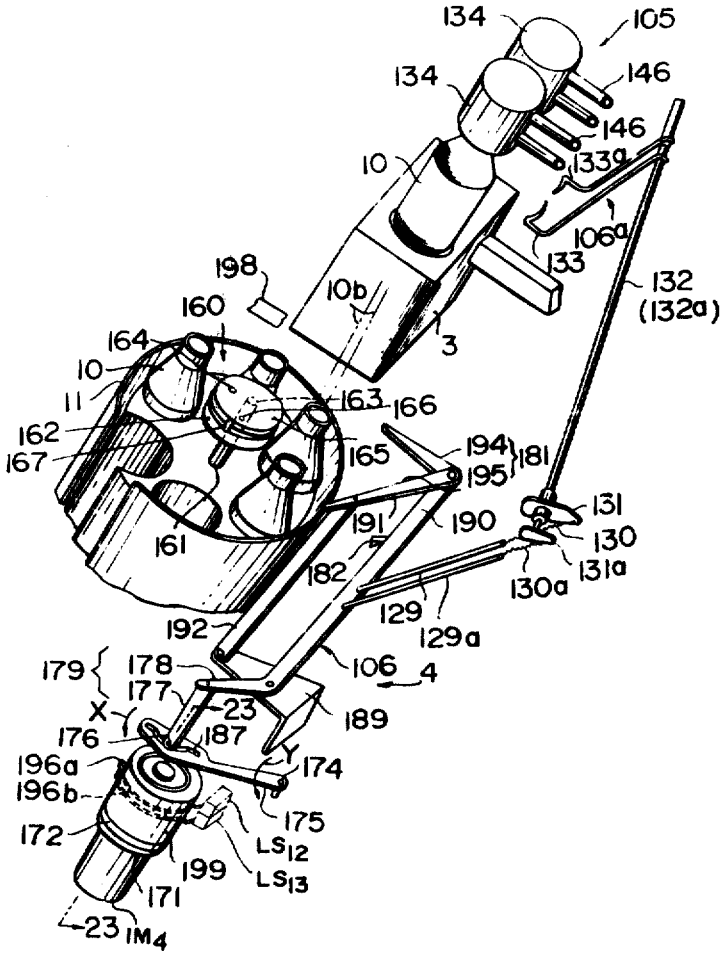
FIG. 22 is a perspective view of the yarn transfer section.
Figure 24:
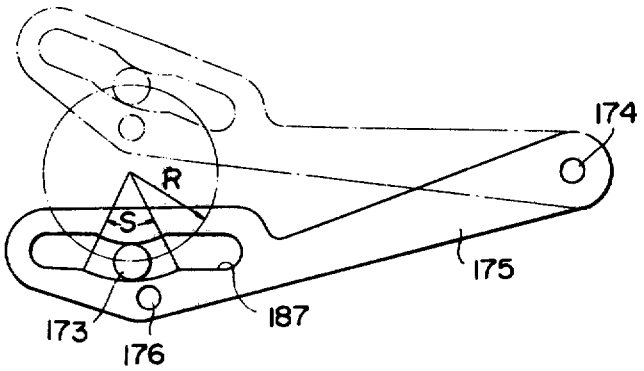
FIG. 24 is a plan view of the swinging lever.

As the yarn clamp of the magazine 11, a yarn-sucking mechanism 160 such as shown in FIGS. 22 to 24, is mounted near the center of the rotary magazine 11. This yarn-sucking mechanism 160 (FIG. 22) comprises a receiving stand 162 attached to the top end of each suction tube 161, a sucking hole 163 formed by opening the upper end of the suction tube on the surface of said receiving stand, a lid 165 having a yarn-sucking opening 164 for sucking and catching the yarn end 10*b* of the cop 10 and being provided eccentrically rotatably on the receiving stand 162 by means of a pin 166, a butt piece 167 projected from the side face of the lid 165, a coil spring (not shown) interposed between the lower face of the lid 165 and the pin 166 to allow the lid 165 to normally close the sucking opening 163, and a stopper (not shown) for controlling the return position of the lid 165, installed between the lid 165 and the receiving stand 162. As shown in FIGS. 22 to 26, a yarn end-treating section is formed so that the yarn end 10*b* spread between the yarn end take-out mechanism 105 and the cop 10 charged into the magazine 11 through the charging section 3 is guided and transferred to the yarn-sucking opening 164 of the yarn clamp disposed near the center of the magazine, and is sucked and caught by said opening 164. By provision of this yarn-treating section, the yarn end is held until transfer of the cop, so that yarn typing can be performed effectively. This yarn end-treating section comprises a yarn transfer mechanism 105 (FIG. 22 and 25) for guiding the yarn spread between the cop and the yarn end take-out mechanism 105 into the yarn-sucking opening 164 when the charging section 3 is lifted after charging the cop 10 to the magazine 11, a yarn-gathering mechanism 106*a* and a hair clipper-like yarn-cutting mechanism 107 installed with a motor IM4. The yarn transfer mechanism 106 which is moved to the yarn-sucking opening 104 above the magazine 11 substantially in parallel thereto comprises a collar 171 (FIG. 23) fixed to a shaft 170 of the motor IM4, a driving cylinder 199 inserted coaxially onto the shaft 170 so that it is rotated through a friction clutch 172 by said collar 171, a swinging lever 175, one end 174 (FIG. 22) of which is pivoted so that it is operated through a crank pin 173 by the cylinder 199, a four-link rotary chain 180 operated by said swinging lever 175 through connecting means 179 including a connecting rod 177, one end of which is pivoted on an appropriate part 176 of the swinging lever 175 and a connecting lever 178, a scissor-like yarn guide 181 integrated with one link of said chain 180, and a lid-operating piece 182 protruding from said chain 180.

Said friction clutch 172 (FIG. 23) includes a compressing spring 183 disposed in a recess of the driving cylinder 199 and a friction plate 184 pressed by said spring 183 providing frictional contact with the upper face of collar 171. A nut 185 is screwed onto a cylindrical portion of the collar 171 to hold the driving cylinder 199.

A long groove 187 (FIG. 24) which is linear at both ends and has an arc-like shape in the intermediate portion thereof is formed in the swinging lever 175 and crank pin 173 is inserted into groove 187. The other end of the lever 175 is pivoted on a suitable part 174 so that the radius of curvature R of said arc-like portion is equal to the rotation radius of the crank pin 173. The center angle S of the arc is so adjusted as to attain a desired stop time and the long groove 187 is so formed that the crank pin 173 slides and swings in said long groove 187.

One of four links of the four-link rotary chain 180 (FIG. 22) is a stationary first link 189 fixed to the feeder, and second, third and fourth links 190, 191, 192 are disposed in counterclockwise order. One end of the second link is formed integrally with said connecting lever 178 and pivoted on a suitable part of the said stationary first link 189. A scissor-like yarn transfer guide 181 is formed of a first yarn guide 194 extending from the other end of said second link 190 outwardly of the chain and said third link 191 which opposes the first yarn guide 194, and also acts as a second yarn guide 195, and this scissor-like yarn transfer guide is so constructed that when it approaches the yarn-sucking mechanism, 160, the distance between the scissors is narrowed and yarn guide faces are formed on the opposed faces of the scissors so that a plurality of yarns can be simultaneously transferred. Further, when said linkage is advanced and swung by rotation of the driving cylinder 199, the yarn transfer guide 181 guides and transfers the end yarn **10*b* to the yarn-sucking mechanism 160 and simultaneously causes the lid-operating piece 182 to bend and protrude to the lower face of the second link 190 so that it is engaged with the top piece 167 to open the lid 165 of the yarn-sucking mechanism 160.**

A yarn-cutting controlling cam **196*a* and a controlling cam 196*b* for stopping the motor IM4 are adjustably fitted and fixed on the outer periphery of said cylinder, and a yarn-cutting switch LS12 and a motor-stopping switch LS13 are actuated in response to signals of said cams 196*a* and 196*b*, respectively, so that a motor IM5 (FIG. 3) of a hair clipper-like yarn cutting mechanism 198 positioned just above the yarn-sucking mechanism 160 (FIG. 22**) is actuated but the motor IM4 is stopped.

The yarn-gathering mechanism **106*a* operated in relation with said yarn transfer mechanism 106 comprises connecting rods 129 and 129*a*, one end of each of said rods being connected to said second link, coil springs 130 and 130*a* connected to the other ends of said connecting rods 129, and 129*a*, respectively, and two arms 131 and 131*a* engaged with said springs 130 and 130*a* and fixed on shafts 132 and 132*a* rotatably supported, shaft 132 being hollow and the other shaft 132*a* being concentrically inserted into hollow shaft 132. Two yarn guides 133 and 133*a* fixed on shafts 132 and 132*a* are extended between said yarn take-out mechanism 105 and the charging section 3.**

After the bunched yarn wound on the top end portion of the cop 10 is unwound by the yarn end take-out mechanism 134 in the travelling cop feeder and the yarn end **10*b* is taken out, the cop 10 is charged in the feed position of the magazine 11 through the vertically moving charging mechanism and the motor IM4 is actuated by change-over of the switch on return of the charging mechanism, so that the driving cylinder 199 is rotated in a direction indicated by arrow X and the swinging lever 175 is simultaneously swung in a direction indicated by arrow Y, whereby the four-link rotary chain 180 is allowed to advance toward the lid 165 through the connecting means 179 while narrowing the distance between first and second yarn guides 194 and 194. When the lid-operating piece 182 makes contact with the top piece 167, the lid 165 begins to move with the pin 166 as a fulcrum. While the crank pin 173 is sliding in the arc-like portion of the groove 187 of the swinging lever 175, the base of the yarn guide 181 stops temporarily just above the yarn-sucking opening 164 while guiding and holding said yarn end, and the yarn-sucking opening is connected to the suction opening 163 and catches the yarn end 10*b*.**

Coincidentally with the above operation of the yarn transfer mechanism 106, the connecting rods 129, and **129*b* of the yarn gathering means 106*a* are attracted and shafts 132 and 132*a* are rotated by means of arms 131 and 131*a*, and the yarn guides 133 and 133*a* guide the upper portion of the spread yarn to gather the yarn toward the yarn-cutting means 107. During this period, the yarn-cutting switch LS13 is actuated by the yarn-cutting controlling cam 196*a* to drive the yarn-cutting motor IM5, whereby the yarn 10*b* spread between the yarn end take-out mechanism 134 and the yarn-cutting mechanism 198 is cut by the yarn-cutting mechanism 198 and the cut yarn end 10*b* on the side of the cop 10 is sucked in the sucking opening 164** and is thus caught.

If the operation of the magazine 11 is accidentally stopped, for example, when the cop-charging member 30 is lowered to the cop-receiving point where one cop is left, even if the stop lever 91 is released as indicated by the dotted line by said signal, the bottom plate 33 strikes on the top end of the remaining cop and is not opened. Accordingly, when the cop-charging member 30 is lifted again, the stop lever 91 is engaged with the projection 35 again and the charging member 30 is returned to the normal position while holding the remaining cop 10 alone. In this case, supply from the feed-out section is controlled by phototube switches PH1 (FIG. 11) and PH2 (FIG. 7) to prevent double feeding. Accordingly, although the yarn-gathering means **106*a* is going to guide the yarn in response to the actuation of the yarn transfer mechanism 106 (FIG. 22), either of the yarn guides 133 and 133*a* strikes on the remaining cop 10 of the charging member 30 and its rotation is inhibited, whereby coil springs 130 and 130*a*** are freely stretched to absorb its rotation power and thus the operation is completed without any disadvantage.

After the crank pin 173 has passed through the arc-like portion of the groove 187, the swinging lever 175 is swung in the opposite direction and the linkage 180 retreats from the yarn-sucking mechanism 160; the lid proper is automatically rotated and returned to the original position by means of an installed spring (not shown) to close the sucking opening 163. When the yarn guide 181 reaches the position furthest from the yarn-sucking mechanism 160, the motor-stopping switch LS12 is actuated by the motor-stopping cam **196*b* to stop the motor IM4 and the yarn guides 181, 133 and 133*a*** are returned to the original starting positions.

Figure 27:
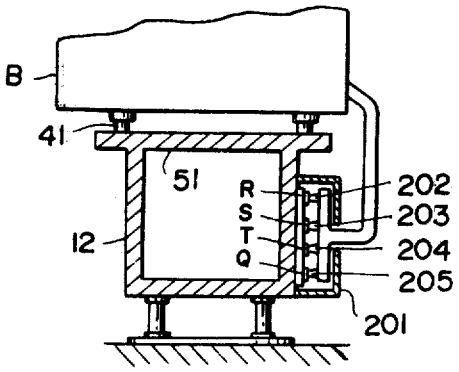
FIG. 27 is a sectional side view of the travelling rails.
Figure 25:
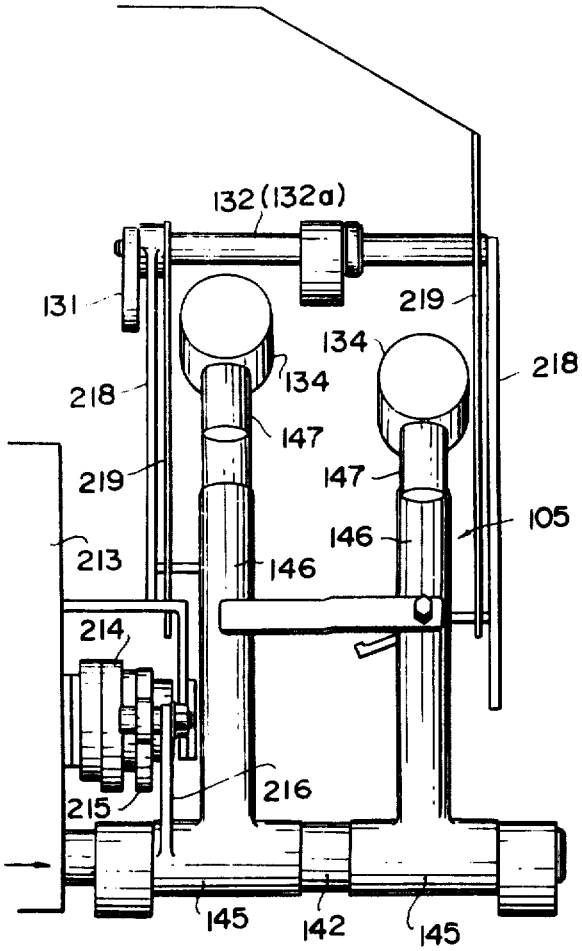
FIG. 25 is a front view of the yarn end-treating mechanism.
Figure 26:
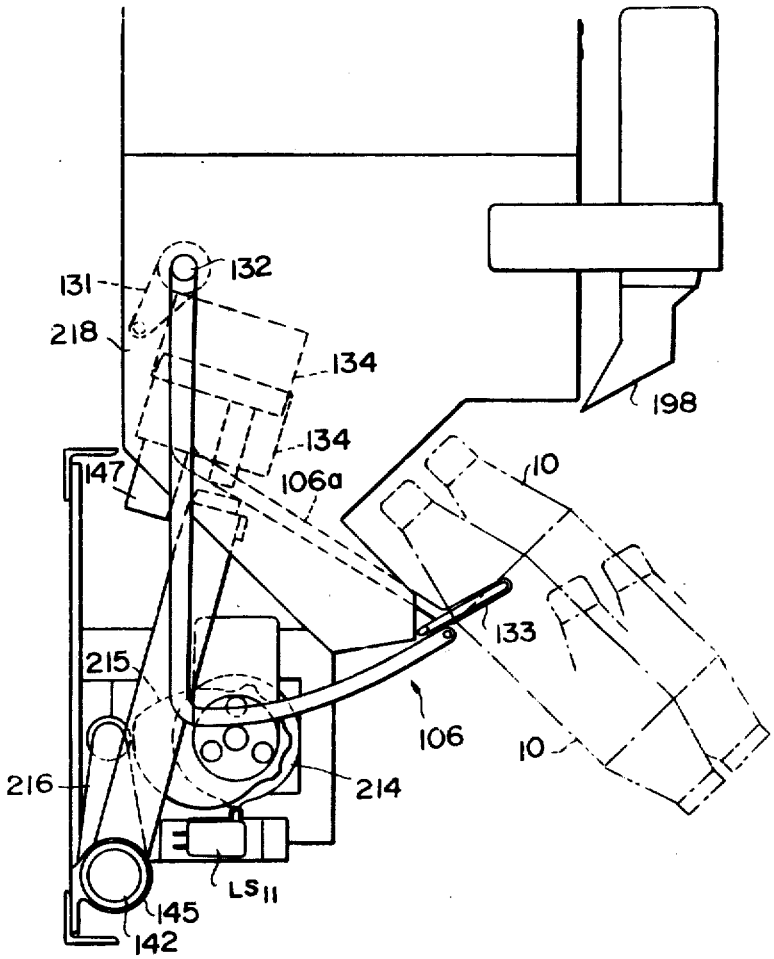
FIG. 26 is a side view of the treating mechanism of FIG. 25.

Supply of cops 10 to the travelling cop feeder B is accomplished by a limit switch LSu1 (FIG. 2) (sensing filling of cops and terminating the cop delivery), a limit switch LSu2 (preventing maloperation) and a limit switch LSd1 (for sensing a shortage of cops and issuing a signal for cop replenishment) which are operatively associated with a cop-sensing member provided in the containing unit 1 of the cop feeder B. The transfer device C is driven by the signal emitted from the side of the feeder B, and as shown in FIG. 27, three feeder lines R, S and T connected to a three-phase power source and a signal line Q are provided in a bus duct 201 mounted along the travelling rail 12 disposed along the front side of the winder A. Collector brushes 202, 203, 204 and 205 are provided as current supplying devices on the lower part of the feeder to drive the motor IM1 for travelling wheels, said brushes corresponding to the feeder lines R, S, T and the signal line Q, respectively. The wheel 41 is rotated by the motor IM1 through a transmission gear device 46 (FIG. 3) to transport the feeder B, and when the push rod 47 strikes one of the reversion stoppers 16, 17 at both ends of the rail 12, the intermediate gear is disengaged in the gear device 46 to reverse the travel direction of the feeder B.

It is to be noted that the above circuits may be replaced by any other device for establishing a signal communication between the feeder B and the transfer device C such as a wireless communication system or a mechanical interlock change-over control device or a device controlled by light rays, electromagnetic radiation or sound waves.

When the quantity of cops 10 in the containing section 1 (FIG. 2) of the feeder B falls to a level lower than the sensing member $K_3$ and it becomes necessary to feed cops into the containing section, the sensing members $K_1$, $K_2$ and $K_3$ are free of applied pressure. The limit switches LSu1, LSu2 and LSd1 are closed by the sensing members $K_1$, $K_2$ and $K_3$, and the circuit 313 (FIG. 28A) in the feeder B for transmitting the instructions for cop replenishment is closed. The instruction signal is transmitted from relay $RY_5$ through line S and signal line Q to the transfer device C (FIG. 2) and energizes the relay MSo (FIG. 28A) of the relay circuit. Motors M1, M2 and M3 (FIG. 1) for driving the lifting and supply conveyors 61, 100 are set into operation. Thus, the cops 10 on the conveyor 61 can be supplied into the containing section 1 through the chute device 62 not only when the feeder B is stationary or travelling in the direction opposite to that of the conveyor 61, but when the feeder is travelling in the same direction as the conveyor 61, thanks to the greater velocity of the conveyor 61 than that of the feeder B. When the cops supplied into the containing section 1 act on the sensing member $K_3$ for opening the limit switch LSd1, the supply conveyor is still driven due to the self-hold of the relay $RY_5$ and the closure of the limit switches LSu1 and LSu2. As the cops are stored further and act on the sensing member $K_2$ for opening the limit switch LSu2, since the limit switch LSu1 is still closed, the supply of cops is continued through the conveyor belt. When the cops are stored further and act on the sensing member $K_1$ for opening the limit switch LSu1, the relay $RY_5$ is deenergized and the circuit 313 for transmitting the instruction signal for cop replenishment is opened for bringing the supply and lifting conveyors 61, 100 to a standstill and terminating cop replenishment. When the cop quantity in the containing section falls to a level lower than the sensing member $K_3$, as the cops are supplied to each magazine 11 from the reciprocating feeder, the transfer device C is started in the same way as above for performing cop-replenishing operation. In the meantime, the sensing member $K_2$ is provided for the purpose of preventing malfunction caused by chattering of the uppermost sensing member $K_1$ resulting from each cop charging operation.

Figure 9:
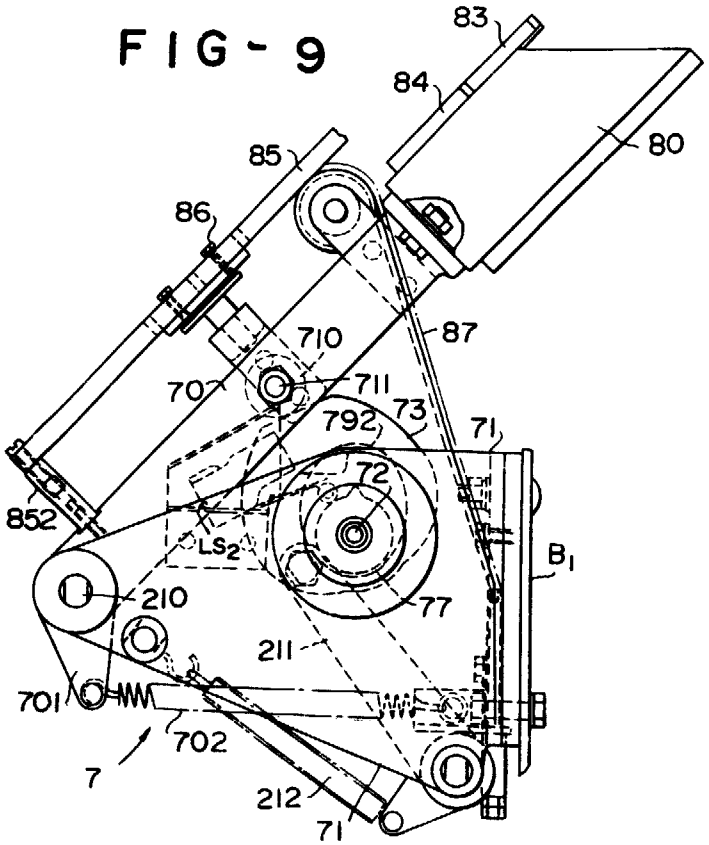
FIG. 9 is a side view of the charging unit shown in FIG. 6.

In FIG. 5, the numeral 49 denotes a unit mounted on the cop feeder B for receiving the current from the feeder line provided to the lateral face of the rail 12, the numeral 462 (FIG. 4) an idler permanently engaging with driving gear 401, the numeral 551 a pressure spring, the numeral 561 (FIG. 2) a shifter, the numeral 63 a chute guide for chute device 62, the numeral 611 (FIG. 3) a belt guide for conveyor belt 61, the numeral 621 (FIG. 13) a belt lift for chute device 62, the numeral 751 (FIG. 5) a solenoid for magnetic clutch 75, $B_1$ a machine frame of the cop feeder B, the numeral 206 (FIG. 2) a lamp, the numeral 207 a dust-collecting box, the numeral 208 a blower, the numeral 210 (FIG. 8) a supporting shaft, the numeral 211 a brake lever, the numeral 212 (FIG. 9) a spring, the numeral 213 (FIGS. 25, 26) a motor for driving the yarn end take-out section, the numeral 214 a clutch, the numeral 215 a cam, and the numeral 216 a swinging lever for swinging the air feed tube 146 around the hollow tube 142. The numeral 218 denotes a supporting lever, the numeral 220 (FIG. 28A) a blower circuit, the numeral 221 a circuit for driving motor, the numeral 222 a blower operation circuit, the numeral 223 a circuit for stopping the end of the machine frame, the numeral 224 a circuit for detecting the absence or presence of cops in the charging section, the numeral 225 an electric source lamp, and the numeral 226 a travelling clutch circuit.

Figure 2:
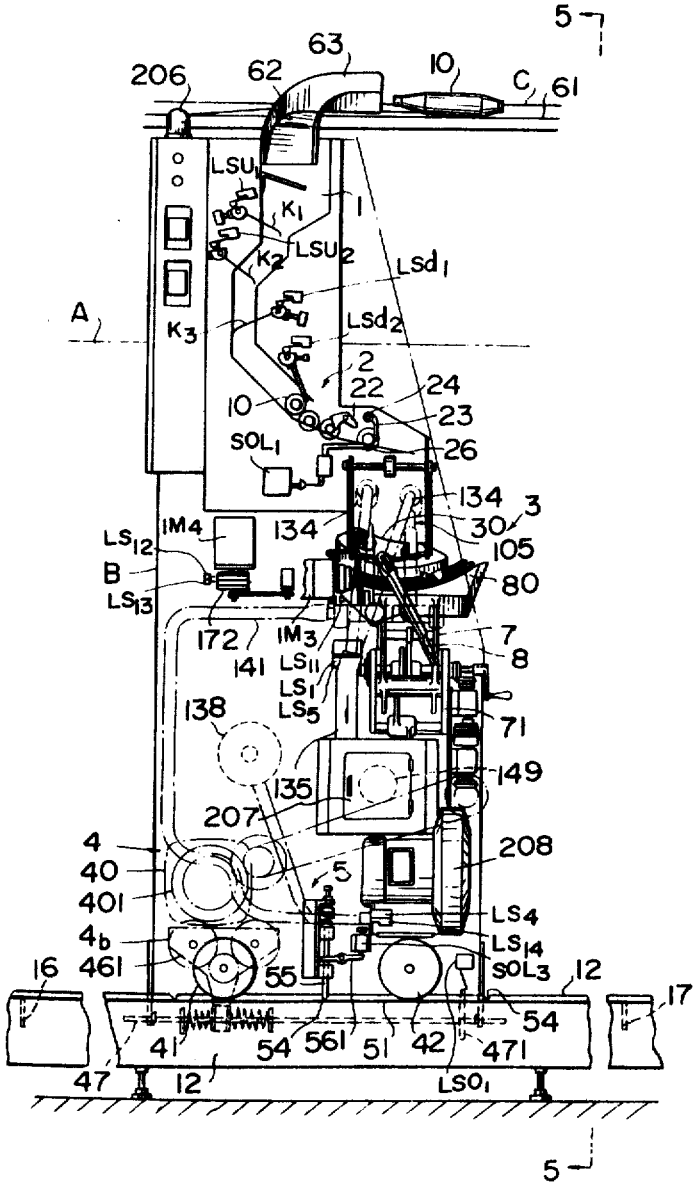
FIG. 2 is a front view of a cop feeder.
Figure 3:
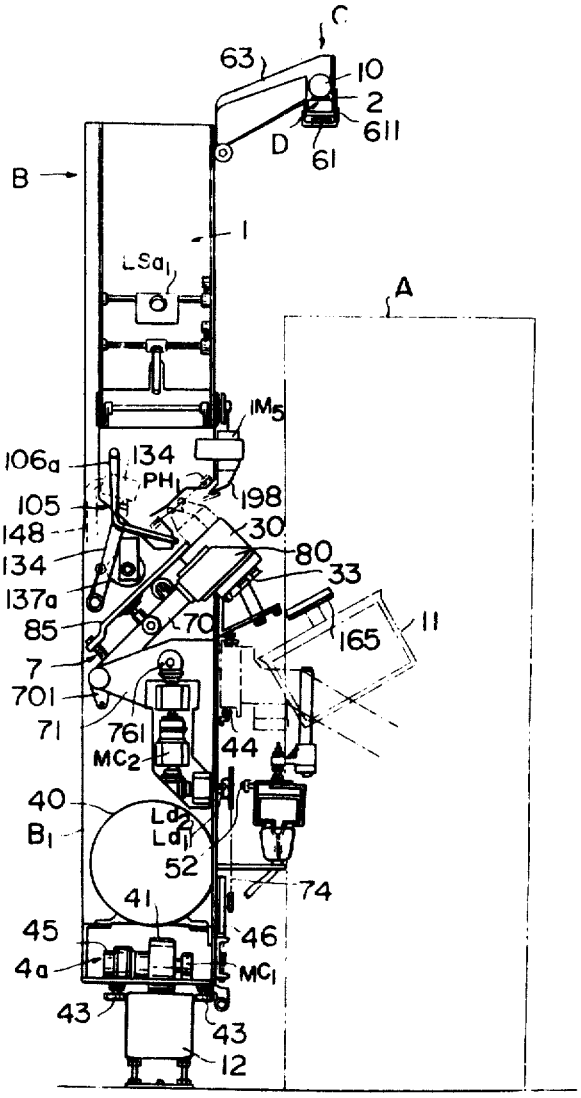
FIG. 3 is a side view of the cop feeder shown in FIG. 2.
Figure 4:
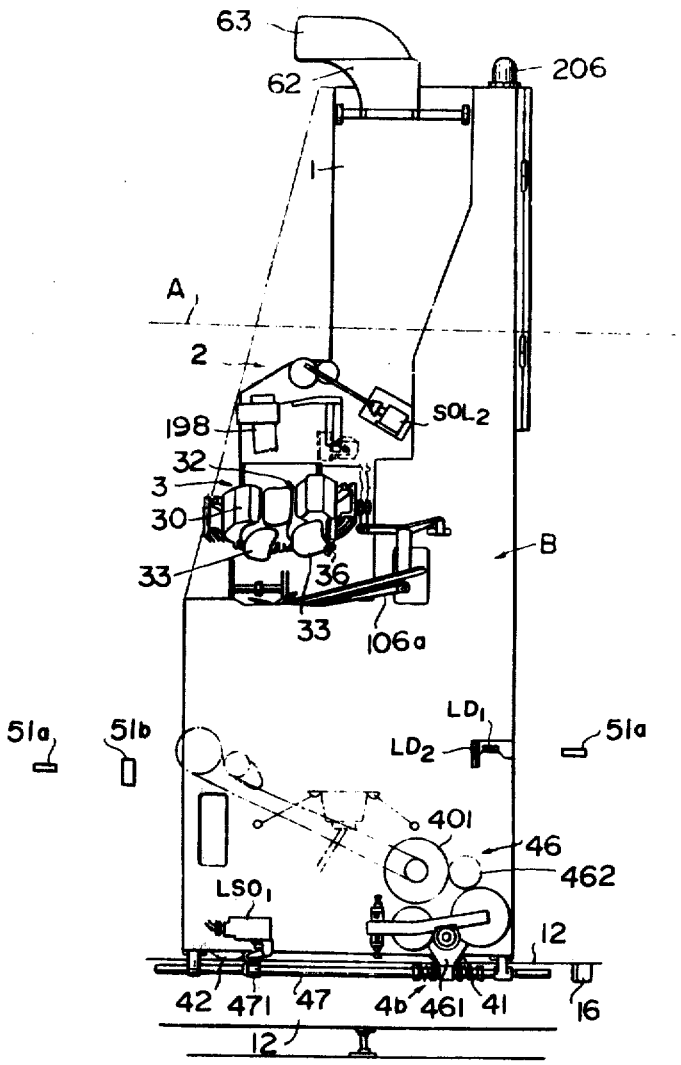
FIG. 4 is a back view of the cop feeder shown in FIG. 2.

The cop feeder B in FIGS. 2 and 3 travelling on the rails with cops 10 held in the cop holder 30 assumes the cop-receiving position isolated from the row of magazines 11 and out of contact with any of the sections of the thread winder A. When the cop feeder B approaches a magazine 11, the magnetic clutch MC1 and the brake device 45 are actuated by means of the electrically operated primary control device 4a comprising a combination of the magnet 52 and the reed switch 53 and in a position ahead of the magazine. The high speed drive roller 41 is now disconnected from the drive device 40 and, from that time, the feeder B travels by inertia at a reduced speed.

As the detent pin 55 (FIG. 2) of the mechanically operated secondary control device of the stop position control unit 5 snaps into the groove 54 on the positioning plate 51, the sensing switch LS14 is turned off to disconnect the clutch $MC_3$ and the cop feeder B is stopped, and the switch LS4 (FIG. 2) transmits an instruction signal for starting the cop supply for operating the magnetic clutch MC2 (FIG. 3) and thereby setting the lifting means 7 into actuation. The rotary shaft 76 and the control shaft 72 are now rotated and the lifting frame 70 is lowered to the cop-charging position in which the holder 30 is brought close to the magazine 11. The lid-opening solenoid SOL4 of the charging section is actuated by operation of the cam 77 (FIG. 6) and the switch LS1 facing thereto.

When the engaging lever 36 (FIG. 12) engages with a cop-receiving pocket 15 in the magazine 11 and hook 362 engages with the rim of the socket 15, the cop holder precisely assumes the cop-charging position, and the switch LSs is not in operation. The solenoid SOL4 of the charging control device 9 is energized instantly for rotating the lever 93 and disengaging the lever arm 91 from its contact with the projection 35 on the cover plate 33. The cop 10 so far held on the cover plate 33 is now dropped upon opening of the cover plate by its own weight and charged into the cop-receiving pocket 15 in the magazine 11.

If there are no cops in the two receiving pockets 15 of the magazine 11, two cops are charged simultaneously from the cop holder 30 and, if a cop or cops are held in one or both of the receiving pockets 15, rotation of the lid plate 33 is hindered by its abutment with the upper end of the remaining cop, as shown in FIG. 11, even when the engaging lever 91 is disconnected from the projection 35. Thus, the cover plate 33 is not opened, and the cop-charging operation does not take place. When the engaging lever 91 is turned to its starting position prior to the elevation of the cop holder 30, the engaging lever 91 again engages with the projection 35 of the cover plate 33. Thus the cop is not supplied to the magazine 11 charged with the remaining cop, but again held and stored in the cop holder 30. Accordingly, the presence or absence of cops in the magazine 11 can be sensed by a highly simplified mechanism for attaining selective cop charging into the magazine.

When the timing of descent of the holder 30 of the cop charging section 3 coincides with that of the revolution of the magazine 11 of the thread winder A, the engaging lever 36 abuts of the upper surface of the magazine 11 in the course of descent of the cop holder 30, and does not snap into the cop receiving pocket 15. Thus, the switch LSs is depressed for the time being the halting the holder 30 in the above-mentioned position, while the solenoid SOL4 of the charging control means 9 is not energized. As the magazine 11 rotates further and the engaging lever snaps into the cop-receiving pocket 15, the holder 30 is entrained in rotation by the magazine 11. The above-mentioned cop charging process is started when the cop-receiving pocket 15 in the magazine 11 is correctly aligned with the slot 32 in the holder 30 and ready for cop charging.

When the magazine 11 is rotated for cop exchange operation while the cop is being charged from the holder or while the cop is held by both the magazine 11 and the holder 30, since the engaging lever 36 is engaged with the rim of the opening of the cop receiving pocket 15 in the magazine 11, the holder 30 is entrained in rotation integrally with rotation of the magazine 11 and travels therewith along the guide frame 80. The cop charging can thus be completed in the manner described above.

Upon completion of the cop-charging operation, the control lever 93 of the charging control device 9 is returned to its starting position, while the holder 30 is elevated to its starting position and halted there by the control shaft 72.

Then, the yarn transfer mechanism 106 (FIG. 22) is actuated. More specifically, the electric motor IM4 is rotated to rotate the second link 190 in the same direction by means of the crank pin 173 and swinging lever 175, and the yarn guide 194 of the third link 191 and the yarn guide 195 are caused to approach each other and are advanced to the yarn-sucking side while holding the yarn spread between the guides 191 and 194 on the yarn-guiding faces. When the base of the yarn guide 181 reaches the position just above the yarn-sucking mechanism 160 of the magazine 11, the yarn end is sucked and caught in the yarn-sucking mechanism 160 and the yarn spread between the yarn-sucking opening and the yarn take-out mechanism is pushed by the yarn-gathering mechanism 106*a* energized simultaneously with said yarn transfer mechanism and is cut on contact with the cutting mechanism 107. The so cut upper and lower yarns are sucked and caught in the yarn take-out mechanism 105 and the yarn-sucking opening 164. Then, the direction of rotation of the lever 175 is reversed and the yarn transfer mechanism 106 and yarn-gathering mechanism 106*a* are returned to the origninal starting positions.

Coincidentally, the engaging pin 55 of the stop position-determining member 5 is disconnected by actuation of the solenoid SOL3 to rotate the driving roller 41 of the travelling mechanism 4*a* and to move it to the position of the next magazine, and thus the above operation is similarly repeated.

When the charging holder 30 is lifted and set at the receiving position below the feed-out section 2, feeding or non-feeding of the cop which has been contained in the charging holder 30 is detected by sensing switches PH1 and PH2, and the solenoids SOL1 and SOL2 are actuated depending on the presence or absence of the cop 10 to effect selective replenishment of cops to the charging holder 30.

Then, in the embodiment shown in the Drawing, when a cop 10 is charged into the charging member 30, the yarn take-out mechanism 105 is lowered and the top end portion of the cop 10 is capped on the cylinder cover 134, and the capping position is set by abutment of the position-determining member 151*a* to the conical face of the yarn-wound portion of the cop 10. Compressed air from the air feed section 136 is projected at a certain predetermined angle to the bunched yarn portion 10*a* of the cop from the nozzle 155. Accordingly, the bunched yarn 10*a* is unwound by the projected air stream while a secondary air stream guided by the projected air passes through the outer air passage 151*b* at the open end portion to promote unwinding of the bunched yarn. The unwound yarn arrives at the filter 149 of the exhaust section 135, and is separated from air and stored. After take-out of the yarn end, the yarn take-out mechanism 105 sucks the yarn end and holds it, and it is lifted and returned to the starting position while spreading the yarn between the yarn take-out mechanism 105 and the cop.

Figure 28A:
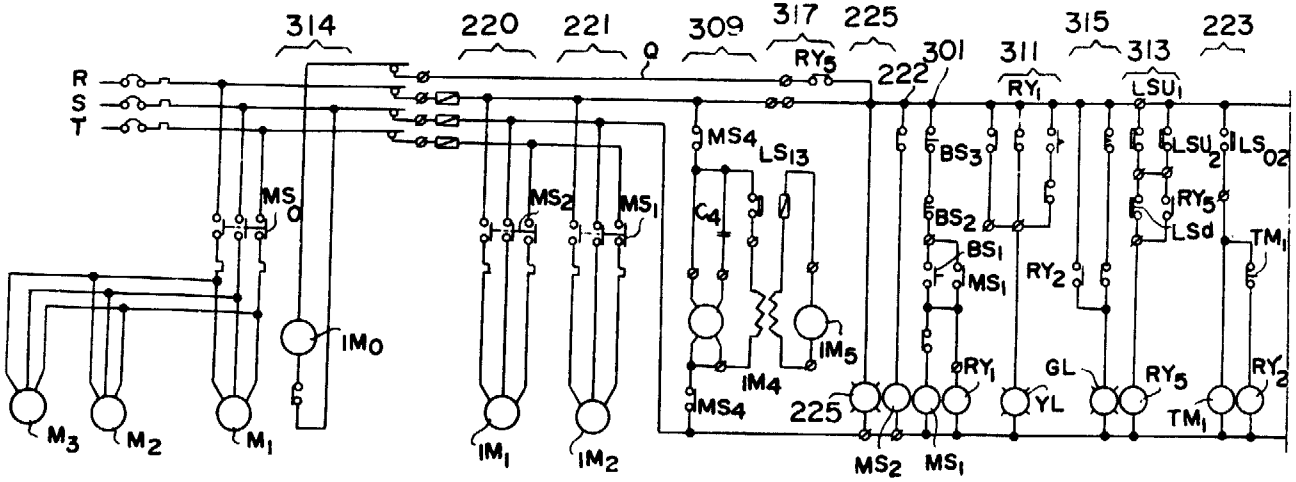
FIG. 28A is a diagram showing a part of the complete electric circuit.
Figure 28B:
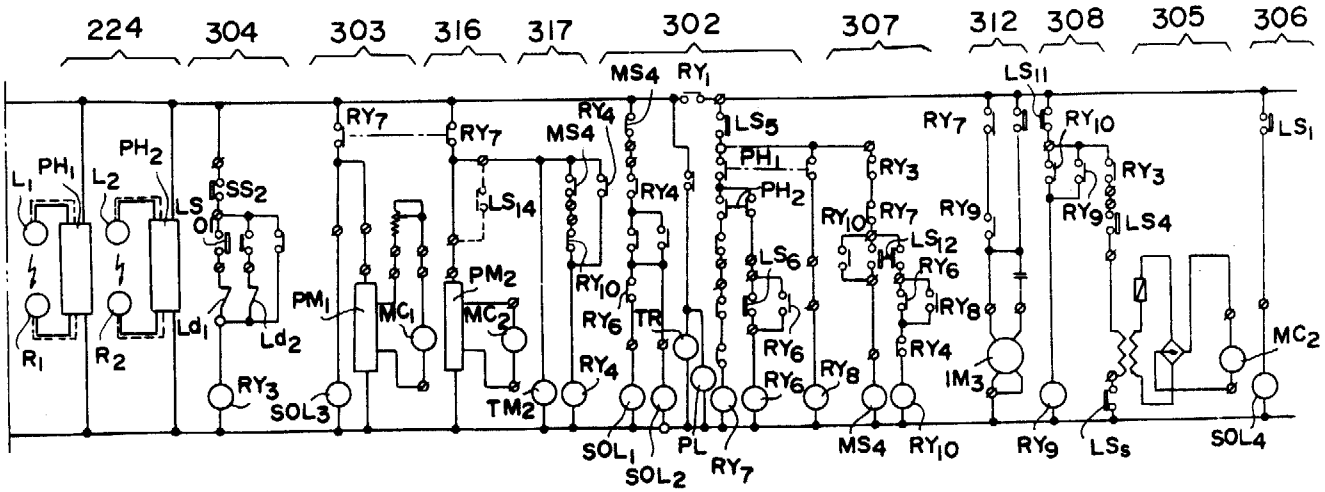
FIG. 28B is a diagram showing another part of the complete electric circuit.

Electric ciruits such as shown in FIGS. 28A and 28B are used for controlling each of the foregoing operations, which will now be described by reference to FIGS. 28A and 28B. When a prescribed quantity of cops 10 are contained in the containing unit 1 and cops 10 are replenished in the charging section 3 ready for operation at the receiving position, if the electric source switch is turned on under such conditions that the limit switch LSo1 is in the state shown in FIG. 28B, the magnet switch MS2 (FIG. 28A) is turned on to actuate the blower IM2 of the yarn take-out section of the feeder B. Then, if the push button BS1 (FIG. 28A) is pressed, the driving operation circuit 301 is closed, and the magnet switch MS1 and relay RY1 are turned on and the motor IM1 of the driving device 40 is actuated by the switch MS1. A circuit 311 for a lamp indicating the stop due to defective operation is opened by contact RY1 and a series of operation circuits are closed. In the charging section 3, since the switch LS5 is turned on at the lifted receiving position by the cam and the phototube switch PH is changed over by the cop, the feedout relay circuit 302 is closed to excite the relay RY7. The contact RY7 of the stopper-disconnecting circuit 303 is turned on by the relay RY7, and hence, the circuit 303 is closed to actuate the solenoid SOL3 to disconnect the detent pin 55 from the groove 54 of the position-determining plate 51 and to actuate the travelling clutch MC1, whereby the feeder B is allowed to initiate high speed travel by the high speed driving roller 41. (At this moment, the contact RY7 of the circuit 315 for a lamp indicating temporary stop is opened and the lamp is turned off.) When the reed switch Ld2 is turned on by the travel of the feeder, the travel-stopping circuit 304 is closed, and the latching relay RY3 is closed and the contact RY3 of the circuit 305 for vertical movement of the charging section is turned on to lower the charging section 3 and make it ready for operation. Then, when the relay contact RY3 of the cop feed circuit 302 of the charging section is turned off, since the relay RY7 is turned off, the contact RY7 of the stopper-disconnecting circuit 303 is turned off and the stopper solenoid SOL3 is turned off. Simultaneously, the contact RY7 of the low speed travel circuit 316 is turned on to actuate the magnetic clutch MC3 of the low speed driven roller 42, so that the travel of the feeder is changed over to the low speed travel. When the detent pin 55 is then engaged with the groove 54 for stopping at the predetermined position, the limit switch LS14 is turned off to close the low speed travel circuit 316, whereby the feeder is stopped at the predetermined position. At this moment, the limit switch LS4 is pressed by the engaging pin 55 and turned on to close the charging section-operating circuit 305. Accordingly, the clutch MC2 of said circuit 305 is actuated to rotate the shaft for vertical movement of the charging section and to lower the charging section 3 to the vicinity of the magazine 11. At the charging position, the cam 77 turns on the limit switch LS1 (see FIG. 28B illustrating the relation between the cam and switch) to close the circuit 306 for opening and closing of the lid of the charging section and to release the engagement of the lid 33 by the solenoid SOL4.

Accordingly, when no cop is left in the magazine 11, a cop 10 is charged into the magazine 11 from the holder 30, but when remaining cops are present in the magazine, the cover 33 is not opened and the limit switch LS1 is opened by the cam 77 to deenergize the solenoid SOL4. At this point, the connecting lever 91 is returned to the starting position and the cop 10 is lifted while keeping the cover 33 closed. If the magazine 11 is being rotated when the charging section 3 is lowered, the detent pin is pressed and the limit switch LS5 in the charging section-operating circuit 305 is turned off to stop lowering of the charging section, and the charging section is lowered again after stop of rotation of the magazine. If the magazine is rotated after lowering of the charging section 3, the charging section 3 is rotated synchronously with the magazine by the detent pin, and if the charging section 3 is then lifted, the cam 78 opens the limit switch LS2 of the travel-stopping circuit 304 to turn off the relay RY3, whereby the contact RY3 of the charging section-operating circuit 305 is turned off and simultaneously, the contact RY3 of the cop feed-out circuit 302 in the charging section is turned on and the contact RY3 of the yarn transfer circuit 307 is turned on, while the clutch MC2 is disconnected by turn-off of the switch RY3 of the charging section-operating circuit 305 and the limit switch LS5 is turned on by inertia rotation and spring tension, so that the charging holder 30 is returned and stopped at the receiving position. Since the charging section becomes empty on charging of the cop, the relay RY8 is turned on by the relay contact PH1 of the phototube and also the contact RY8 of the yarn transfer circuit 307 is turned on to turn on the relay RY10.

When the contact RY10 of the yarn transfer circuit 307 is thus turned on to turn on the magnet switch MS4, the contact MS4 of the cop feed-out circuit 302 is turned off to stop cop replenishment and travel of the feeder. On the other hand, the contact MS4 of the circuit 309 for the yarn transfer motor is turned on to close the motor circuit 309 and to rotate and actuate the yarn transfer motor IM4. Since also the relay contact RY10 is turned on, the relay circuit 308 is closed to attain self-hold in the relay RY9, and the contact RY9 of the take-out motor circuit 312 is turned on to rotate take-out motor IM3 and make it ready for operation.

By rotation of the yarn transfer motor IM4, the limit switch LS12 for self-holding is changed over and the relay RY10 is turned off, and the contacts RY10 and MS4 of the feed-out circuit 302 are turned on and the relay RY4 is turned on. (At this moment, the contact RY4 of the feed-out circuit 302 is self-held, the contact RY4 is ready for replenishment and the contacts RY4 and RY10 of the yarn transfer circuit 307 are turned off.)

When the second link 190 of the yarn transfer mechanism 106 opens the yarn clamp and positions the yarn at the suction opening 164, the limit switch LS13 for yarn-cutting is turned on to actuate the yarn-cutting clipper motor IM5. After the yarn end 10b is shifted to the position of the clipper by the yarn-gathering guide 133 and cut by the clipper, the yarn end is sucked and mechanically gripped by the yarn clamp by return of the yarn transfer lever to the starting position. (In this case, when there is a remaining cop, the yarn-gathering lever is made immobile by said cop.)

After completion of the yarn transfer operation, the magnet switch MS4 is turned off (the limit switch LS12 for self-holding is put off by one rotation) and simultaneously, the contact MS4 of the circuit 302 for feed-out of cops into the charging section is turned on.

By turn-on of the contacts MS4, RY4 and RY8 of the circuit 302, the solenoids SOL1 and SOL2 are actuated, and by actuation of the solenoid SOL1 the cop 10 is permitted to fall and be replenished on the side of the contact PH1. Further, by change-over of the contact PH1 the relay RY6 is turned on to actuate the solenoid SOL2 again to replenish the cop 10 on the side of the feed-out contact PH2. In this case, if there is a remaining cop in the charging section 3, replenishment of cops is performed selectively.

On completion of replenishment of cops, the cop feed-out circuit 302 is closed and the relay RY7 is turned on, whereby the contact RY7 of the stopper-disconnecting circuit 303 is turned on and the travel of the feeder B is changed over to high speed travel again. Simultaneously, the contact RY7 of the take-out motor circuit 312 is turned on to close the take-out circuit 312. Accordingly, the take-out motor IM3 is rotated during travel of the feeder B and the operation of taking out the yarn end of the cop supplied in the charging section 3 is performed by pulsating movement caused by rotation of the cam, and the self-hold limit switch LS11 is changed over by rotation of the take-out motor IM3 and the relay RY9 is turned off to control the rotation of the cam to one turn alone.

The time required for supply of cops at each pause of the feeder B is about 5 to about 6 seconds. If the feeder B is stopped for a time longer than such period, for instance, for more than 10 seconds, the timer TM2 in the circuit 317 is turned on to light the lamp indicating the stop by defective operation and to give an alarm. When the number of cops 10 contained in the containing unit 1 is reduced to the minimum number (two cops), the limit switch LSd2 is turned on to light a pilot lamp PL and to actuate a delayed relay TR to open the cop feed-out circuit 302 after a prescribed period (before the containing unit is empty) and to stop the cop-replenishing operation. Accordingly, also the feeder should naturally be stopped and the travel of the feeder is thus co-related with the circuit 311 for the lamp indicating the stop by disordered operation.

When the number of cops in the containing unit 1 is reduced to such a level that limit switches LSu1, LSu2 and LSd1 are turned on, the cop transfer-instructing circuit 313 is closed and the relay RY5 is turned on.

The contact RY5 of the cop transfer-instructing circuit 313 is thus turned on and self-held to apply a current to the signal feed line Q, and the magnet switch Mso in the conveyor control circuit 314 is turned on to drive conveyor motors M1 and M2 and effect feeding of cops 10 to the feeder B.

When the cops are introduced in the containing unit 1 from below the container unit 1, each limit switch is successively turned on and the switch SW2 is turned off to stop the conveyor motors.

When a trouble or accident occurs at the time of the cop-feeding step, the trouble or accident is detected in said circuit 311 for the stop by defective operation. When the feeder reaches the end of the winder, the travel direction is reversed by the push rod 47, and simultaneously, the limit switch LSo1 is changed over, whereby reed switches Ld1 and Ld2 are changed over in the travel-stopping circuit 304 and during return travel, cops are supplied to every other magazine skipped at the going travel. By turning-on of the limit switch Lso2, the frame end-stopping circuit 318 is activated to turn on the timer TM1 and relay RY2, whereby closing of the temporary stop circuit 315 is indicated by the lamp.

Simultaneously, the contact RY2 of the cop feed-out circuit 302 is turned off to stop the feeder B. The timer TM1 stops the feeder at the end of the winder temporarily to adjust the travel cycle depending on the count of the cop yarn. The travel of the feeder is accomplished by the motor IM1, gear clutches MC1 and MC2 (reduction) and rollers 41 and 42 so that it is stopped for every other magazine at the forward travel and stopped for each of remaining magazines at the return travel. The stop of the feeder is detected by magnet-type non-contact switches and reed switches, and cycle of high speed travel, low speed travel and stopping is repeated.

According to the present invention, since the cop feeder B supplies the cops sequentially to each magazine as it travels in reciprocation alongside the thread winder A, the waiting time can be reduced substantially to nil by setting the travelling speed of the cop feeder as a function of the time expended for cop replenishment and reciprocation of the cop feeder. Moreover, full automation in the cop supply operation results in a saving in man-power and increases in operational efficiency and safety factor and, since the cops are charged to each magazine depending on the presence or absence of cops in the magazine, the risk of malfunction and the resulting disorder can be completely eliminated. If desired, the cop-feeder can be programmed to take charge of 50 to 100 drums at one time with simple maintenance. Further, the feeder can be attached to a winder without any change being made to the machine frame and the feeder can be attached to any of known winders very simply, and complete automation can be attained and the manufacturing rate can be highly improved. Moreover, since the cop feeder can receive articles from the belt conveyor while it is travelling along the machine frame of the winder, the operation can be carried out continuously with a small quantity of cop stocks being held in the containing unit of the feeder. In other words, the quantity of cops in the feeder can be reduced to the necessary minimum level and the capacity of the containing unit can be minimized, with the result that the cost of the feeder can be reduced. Further, according to the present invention, when cop-containing magazines are rotated in such a state that the cop-charging section of the cop feeder is lowered to the charging position, the charging section is so connected with synchronizing means that it is shifted and entrained by rotation of magazines. Therefore, even if the magazine is rotated at the time of cop-charging, the charging member is rotated together with the magazine to avoid change in the relative position between the magazine and charging member, and no positional deviation is brought about. Accordingly, the charging operation can be accomplished accurately and assuredly without fail and no disorder or breakage owing to malfunction is caused, and hence, supply of cops can be performed automatically and the working efficiency can be highly improved. In addition, since the charging section is so constructed that no cops are supplied to positions in the magazine drum where cops are still present and cops are selectively supplied to empty positions, the supply of cops can be performed automatically and selectively with certainty and efficiency while detecting the presence or absence of cops at each cavity. Furthermore, if cops are present, the cop to be charged is not charged and the charging section is lifted again with said cop being held therein for charging to the next position. Therfore, the cop-charging operation can be performed effectively with safety in the operation. Furthermore, complete labor-saving and automation can be attained in operations of taking out the end yarn of the cop, transferring and gathering the yarn to the yarn clamp of the magazine of the winder, cutting the yarn and catching the yarn end of the cop, by employing a very simple structure that can be provided at a very low cost. Also, since the feeder travels so that it stops for every other magazine of the winder during the forward run and during the return run it stops selectively for each of magazines skipped during the forward run, the waiting time of each magazine can be reduced as compared with the case where the feeder stops for each of magazines, and hence, idle operation is prevented in the yarn-winding unit of the winder. Moreover, the running distance between every two pitches of stopping can be sufficiently prolonged, and the travel and stop of the feeder can be performed smoothly without imparting any particular stress to the machine frame. Still further, the travelling speed of the feeder can be increased and the feeder can be stopped at a predetermined position assuredly, and supply of cops to the cop feeder can be automatically controlled. Furthermore, even when remaining cops are present in the magazine at the time of cop-charging, the presence of the remaining cops is automatically detected and double charging is prevented, with the result that malfunction and occurrence of a trouble or accident can be effectively prevented. By dint of the foregoing features, the present invention makes great contributions to the art.

It will thus be seen that the objects set forth above, among those made apparent from the preceding description, are efficiently attained and, since certain changes may be made in carrying out the above process and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. An apparatus for automatically supplying cops to a winder having plural winding units and a rotary cop magazine for each winding unit for holding a a plurality of supply cops, said apparatus comprising a cop feeder travelling along the winder, said cop feeder including A. a halting means for stopping said cop feeder in registry with any one of said magazines of the winder;

B. a containing unit for storing in a line a number of cops;

C. a feed-out section for successively feeding out cops from said containing unit;

D. a charging section waiting at the cop-receiving position below said feed-out section and receiving and holding cops supplied from said feed-out section, said charing section being movable from a position adjacent said feed-out section to a position adjacent said magazine, means for shifting said charging section after receipt of cops to the position adjacent said magazine for charging cops to the magazine, said position being close to the cop supply point of the magazine;

E. a yarn end-treating section comprising a yarn take-out means for taking out the end of yarn wound on the cop present in said charging section;

a yarn-gathering means for gathering the yarn spread between said yarn take-out means and the cop charged in the magazine toward a yarn-sucking opening of a yarn clamp of the magazine to catch the yarn by suction and a yarn-cutting means for cutting said yarn spread between said yarn take-out means and yarn clamp of the magazine.

2. The apparatus as defined in claim 1, further comprising a conveyor disposed above the winder to carry cops to the cop feeder so that cops can be supplied into the containing unit of the cop feeder even while the cop feeder is travelling, and an automatic cop supply unit for controlling the stop of the travel of said conveyor depending on the presence or absence of the cop in said containing unit and automatically supplying a prescribed number of cops to said containing unit of the cop feeder.

3. The apparatus as defined in claim 1, further comprising a control mechanism for driving the cop feeder along the winding units of the winder so that during a forward run of the cop feeder along the winding units the cop feeder stops for every other magazine to supply cops thereto and during a return run the cop feeder stops selectively for magazines skipped during the forward run to supply cops thereto.

4. The apparatus as defined in claim 1, further comprising a spaced control mechanism for moving the cop feeder at a high speed to the position approximating the magazine for which the cop feeder is stopped and changing over the travelling speed of the cop feeder to a reduced speed at a predetermined time, and a stop position-determining member for stopping the cop feeder when the charging section reaches the position in registry with the magazine for which the cop-feeder is stopped.

5. The apparatus as defined in claim 1, further comprising a charging control mechanism for controlling charging and supply of cops depending on the presence or absence of cops in a cop-charging position of the magazine when cops are charged into the magazine from the charging section of the cop feeder.

6. The apparatus as defined in claim 1, wherein said charging section has at least one essentially vertical aperture therethrough for holding a cop and a movable cover plate over the lower end of said aperture, said cover plate being movable between an opening position for feeding a cop and a closed position for retaining a cop, and further comprising a synchronizing mechanism for maintaining the relative position between the cop-containing magazine and the charging section of the cop feeder even when the cop-containing magazine is rotated at the time of charging of cops, by allowing the charging section to move in entrainment with rotation of the magazine, and a cover plate opening and closing mechanism including engaging means movable between an engaged position in which said cover plate is held closed and a disengaged position in which said cover plate can be opened under the weight of a cop, said cover plate opening and closing mechanism being so constructed that (a) only when the cop-charging position of the magazine is empty can the engaging means be moved to disengaged position and a cop in the charging section of the cop feeder be charged by its own weight against said cover plate and (b) when a cop remains in the cop-charging position of the magazine, opening of the cover plate is hindered by the top end of said remaining cop and the cover plate is kept closed by return of said engaging means to said engaged position, said engaging means being so constructed that return to said engaged position can occur only when said cover plate is in said closed position, whereby cops are selectively charged to the cop-charged position of the magazine depending on the presence or absence of cops in said cop-charging position of the magazine.

* * * * *